US005445097A

United States Patent [19]

Fujita et al.

[11] Patent Number: 5,445,097

[45] Date of Patent: Aug. 29, 1995

[54] TANKER FOR THE PREVENTION OF CARGO OIL SPILLAGE

[75] Inventors: Shigetomo Fujita; Tsukasa Hasegawa; Tomoe Hayashi; Osamu Suzuki, all of Tokyo, Japan

[73] Assignee: Mitsubishi Jukogyo Kabushiki Kaisha, Tokyo, Japan

[21] Appl. No.: 214,422

[22] Filed: Mar. 18, 1994

Related U.S. Application Data

[63] Continuation of Ser. No. 696,575, May 8, 1991, Pat. No. 5,342,943.

[30] Foreign Application Priority Data

May 23, 1990 [JP] Japan ..... 2-133611
Jun. 30, 1990 [JP] Japan ..... 2-173101
Feb. 26, 1991 [JP] Japan ..... 3-53951

[51] Int. Cl.[6] ..... B63B 25/08
[52] U.S. Cl. ..... 114/74 R
[58] Field of Search ..... 114/72, 73, 74 A, 74 T, 114/74 R, 121, 125

[56] References Cited

U.S. PATENT DOCUMENTS

| | | | |
|---|---|---|---|
| 3,399,645 | 9/1968 | Dahan | 114/74 R |
| 3,745,960 | 7/1973 | Devine | 114/74 R |
| 3,766,875 | 10/1973 | Baki | 114/73 |
| 4,117,796 | 10/1978 | Strain | 114/74 R |
| 4,241,683 | 12/1980 | Conway | 114/74 R |

FOREIGN PATENT DOCUMENTS

| | | | |
|---|---|---|---|
| 2089783 | 12/1971 | France . | |
| 2031905 | 6/1970 | Germany . | |
| 2529717 | 1/1976 | Germany . | |
| 2827716 | 1/1979 | Germany . | |
| 113997 | 9/1976 | Japan . | |
| 0113997 | 9/1976 | Japan . | |
| 0035082 | 3/1977 | Japan | 114/74 R |
| 16394 | 5/1991 | Japan . | |
| 981017 | 1/1965 | United Kingdom | 114/74 R |
| 1302476 | 6/1970 | United Kingdom . | |
| 1474801 | 7/1974 | United Kingdom . | |
| 2000474 | 6/1978 | United Kingdom . | |

OTHER PUBLICATIONS

API Proceedings of the 1990 Forum on Alternative Tank Vessel Design Jun. 5, 1990.
"Study of Alternative Idea to Double Hull Tanker" API Proceedings of 1990 Forum on Alternative Tank Vessel Design (USA) N. Aikawa, Jun. 1990.
"Double Sided Hull with Mid-Height Deck" National Academy of Sciences (USA) Jul. 1990.
"Report on the Tank Design for Prevention and Mitigation of Oil Pollution" Oct., 1990 Ministry of Transport, Japan.
Patent Abstracts of Japan, vol. 3, No. 80 (M-65), Jul. 11, 1979 of JP-A-54-55988.
English Translation of German Publication "Rules for the Classification and Construction of Seagoing Steel Ships", 1980 Edition, vol. 1, Classification Rules-Hull.
English Translation of Seewirthschaft, "BORO-das (List continued on next page.)

*Primary Examiner*—Edwin L. Swinehart
*Attorney, Agent, or Firm*—Jacobson, Price, Holman & Stern

[57] ABSTRACT

A tanker which can reliably prevent the outflow of cargo oil from cargo oil tank sections (1, 2, 105, 106) in the ship body in the event of damage or injury to an outer plate (8, 9) of the ship body has a double-sided hull construction (4, 104) arranged on opposite sides of each cargo oil tank in the ship's body and a mid-height deck (3, 118) arranged to divide each cargo oil tank into an upper cargo oil tank (2, 106) and a lower cargo oil tank (1, 105). To reliably prevent the outflow of cargo oil in the event of damage or injury to the ship body due to stranding, collision or similar malfunction, the height (H) of the mid-height deck (1, 118) as measured from the ship bottom (8, 108) is determined so that the pressure of cargo oil exerted on an outer plate of the ship's side wall will not be higher than the pressure of sea water. An access trunk (5, 112) and pressure control devices (6, 7, 113, 114) serve for degassing cargo tank sections.

13 Claims, 24 Drawing Sheets

OTHER PUBLICATIONS

Universalschiff der Zukunft?", Nov. 1976. vol. 11, pp. 682–683.

English Translation of "Vorschiriften für Klassifikation und Bau von stählernen Seeschiffen", Edition 1980, vol. II, Chapters 3 and 5.

DD–Z: "Seewirthschaft", Nov. 1976, vol. 11, pp. 682–683 BORO–das Universalschiff der Zukunft.

DE book: "Vorschriften für Klassifikation und Bau von stählernen Seeschiffen", edition 1980 of Germanischer Lloyd, vol. I, sections 24–4 and 4.

De Book: "Vorschriften für Klassifikation und Bau von stählernen Seeschiffen", edition of Germanischer Lloyd, vol. II, sections 15–4 to 6.

TANKER FOR THE PREVENTION OF CARGO OIL SPILLAGE

This is a continuation of application Ser. No. 07/696,575 filed May 8, 1991, now U.S. Pat. No. 5,342,943 issued Sep. 20, 1994.

BACKGROUND OF THE INVENTION

1. Field of the Invention

The present invention relates generally to a tanker. More particularly, the present invention relates to a cargo oil spillage preventive type tanker which assures that cargo oil spillage can reliably be prevented in the event of damage or injury on a part of the ship body due to stranding or similar malfunction. Further, the present invention relates to a cargo oil spillage preventive type tanker including degassing means for discharging an inert gas filled in each cargo oil tank to the outside after cargo oil is loaded.

2. Description of Related Art

A conventional tanker has been heretofore equipped with a predetermined number of separate ballast tanks (each of which is not practically used as a cargo oil tank) in a cargo oil tank section in the ship body in conformity with the regulations relating to the prevention of oil pollution. Specifically, to minimize outflow of a cargo oil in the event of stranding, collision or similar malfunction, a certain section such as separate ballast tanks exclusive of cargo oil tanks is arranged within the range defined by an outer plate of the ship's side wall and an outer plate of the ship bottom so as to protect the cargo oil tanks from damage or injury.

To facilitate understanding of the present invention, typical conventional tankers will briefly be described below with reference to FIGS. 39 to 45 each of which schematically illustrates arrangement of cargo oil tanks.

FIGS. 39, 40 and 41 schematically show a conventional tanker which includes a plurality of ballast tanks 10 and a plurality of cargo oil tanks 12 alternately arranged along the ship's side walls, respectively. With such construction, however, a cargo oil flows out from the cargo oil tank 12 arranged along the ship's side wall when the cargo oil tank 12 is damaged or injured due to a collision or similar malfunction. In addition, a cargo oil flows out from the cargo oil tank 12 when the bottom wall of the tank 12 is damaged or injured.

Next, FIG. 42 and FIG. 43 schematically show a conventional tanker which includes a plurality of double-sided hull constructions. Since a plurality of ballast tanks 4 are arranged along the full length of the ship's side walls, outflow of a cargo oil can be prevented when the ship's side wall is damaged or injured. However, if the bottom wall of a cargo oil tank 12 is damaged or injured, a cargo oil unavoidably flows out through the damaged or injured part on the bottom wall.

Next, FIG. 44 and FIG. 45 schematically show a conventional tanker which includes double bottom constructions. Since a plurality of ballast tanks 11 are arranged along the whole area of the ship bottom, outflow of a cargo oil from cargo oil tanks 12 can be prevented in the event of damage or injury on the ship bottom. However, if a part of the ship's side wall is damaged or injured, a cargo oil unavoidably flows out through the damaged or injured part on the ship's side wall.

As described above, any one of the conventional tankers cannot effectively prevent outflow of a cargo oil when a part of the ship's side wall or the ship bottom is damaged or injured for some reason. To obviate this problem, development efforts have been conducted to provide a tanker including double hull constructions and a tanker including a horizontal bulkhead, as described in the following.

FIG. 46 and FIG. 47 schematically show a tanker including double hull constructions. The interior of each double hull construction serves as a ballast tank 12. Since each cargo oil tank 12 is covered with the ballast tank 13, the entirety of the ship's side walls and the ship bottom is protected from damage or injury by the presence of a plurality of ballast tanks 13. In view of the wide area occupied by the ballast tanks 13, each double hull construction may be dimensioned to be thin in thickness and still can hold a necessary quantity of ballast. In addition, a smallest value within the specified range may be employed for the thickness of each double hull construction from the viewpoint of building a tanker at low cost and cruising it economically. Pursuant to the current provisions in Japanese oil pollution prevention law, the thickness of each ballast tank 13 has to be larger than a smaller value of either 1/15 of a width of the ship body or 2 meters. Therefore, in practice, the thickness of the ballast tank 13 is selectively determined in consideration of the aforementioned conditions.

When a tanker is built with double hull constructions, the thickness of each double hull construction is usually dimensioned to be less than the thickness of a double-sided wall structure in the conventional tanker which is built with double-sided hull constructions. Therefore, although not only the side walls of the ship but also the ship bottom are protected from damage or injury in the presence of a plurality of ballast tanks 13, there is a high possibility that the inner hull of each double hull construction is damaged or injured when an outer plate of the ship's side wall or the ship bottom is damaged or injured by a large shock, because each ballast tank 13 is dimensioned to have a thin thickness. In such case, outflow of a cargo oil from the damaged or injured part of the cargo oil tank 12 is unavoidable.

Next, FIG. 48 and FIG. 49 schematically show a conventional tanker which includes a mid-height deck 3 as a horizontal bulkhead in a cargo oil tank section. FIG. 48 is a cross-sectional view of the conventional tanker similar to a tanker shown in FIG. 4 to FIG. 6, particularly illustrating by way of example arrangement of the mid-height deck 3 as a horizontal bulkhead in the cargo oil tank section. Each of cargo oil tanks 16 to 18 and 24 is filled with a cargo oil 14.

FIG. 49 is a cross-sectional view of the conventional tanker, schematically illustrating by way of example a structure in which a plurality of cargo oil tanks arranged along the ship's side walls in the region above the mid-height deck 3 serving as a horizontal bulkhead are practically used as ballast tanks 15 and all the remaining cargo oil tanks 16 to 18 are used as actual cargo oil tanks.

In a case where a conventional tanker includes a mid-height deck in the above-described manner, the mid-height deck 3 has been inadequately arranged such that it is located at a position lower than a highest draft line 19 in such a manner as to divide the interior of the ship's body into two halves as seen on a transversal plane (see FIG. 48) or it is located at a position directly below the highest draft line 19 (see FIG. 49).

However, when a tanker cruises in practical operation, there arises a case where the tanker cruises with only some of cargo oil tanks filled by a cargo oil. In this case, a draft line is lowered from the highest draft line 19, and the tanker cruises with a draft corresponding to about a half of the depth of the ship's body. When the draft line during practical cruising of the tanker is lowered below the position of the mid-height deck 3, the mid-height deck 3 does not contribute to the prevention of undesirable outflow of a cargo oil in the event of damage or injury to the ship bottom, as described later.

In a case of the conventional tanker including a mid-height deck, e.g., the tanker shown in FIG. 48, the outflow of a cargo oil in the event of damage or injury to the ship bottom can be prevented. However, when the ship's side wall is damaged or injured, the outflow of the cargo oil 14 cannot be prevented.

The tanker shown in FIG. 49 has an advantage that outflow of a cargo oil can be prevented in the same manner as the tanker shown in FIG. 48 when the ship bottom is damaged or injured. However, when the ship's side wall is damaged or injured, especially when a lower cargo oil tank arranged along the ship's side wall is damaged or injured, outflow of the cargo oil 14 cannot be prevented. In FIG. 49, reference numeral 5 designates an air venting tube.

FIG. 50 is a cross-sectional view of the conventional tanker in FIG. 49, particularly illustrating a process of outflow of the cargo oil 14 when a lower cargo oil tank 16 arranged along the ship's side wall is damaged or injured.

In the initial state A immediately after an occurrence of the damage or injury as shown in FIG. 50, since the pressure of sea water is higher than the pressure of a cargo oil 14 in the damaged or injured lower cargo oil tank 16, sea water flows in the lower cargo oil tank 16. This causes the cargo oil 14 in the lower cargo oil tank 16 to be forcibly displaced in the upward direction through the air venting tube 5.

Next, in the intermediate state B at time $T_1$ after occurrence of the damage or injury, the pressure of the sea water which has flowed in the bottom part of the lower cargo oil tank 16 becomes equalized to the pressure of the cargo oil 14 which has been forcibly displaced in the upward direction through the air venting tube 5. At this time, the replacement of the cargo oil 14 having a lower specific weight with the sea water having a higher specific weight begins. In the final state C after time $T_2$, the surface level of the sea water which has flowed in the lower cargo oil tank 16 reaches the upper end of the damage or injured part of the lower cargo oil tank 16. At this time, the outflow of the cargo oil 14 stops and this balanced state is maintained between the cargo oil 14 and the sea water.

In the case shown in FIG. 50, the draft line 19 before an occurrence of damage or injury is located upward of the position of the mid-height deck 3. Thus, a part of the cargo oil 14 in the lower cargo oil tank 16 does not flow out to the surface of the sea but remains in the lower cargo oil tank 16. However, in a case where the draft line is located lower than the position of the mid-height deck 3, the entire cargo oil 14 in the damaged or injured lower cargo oil tank 16 flows out.

As is apparent from the above description, every one of the conventional tankers has the problem that it can not sufficiently prevent the outflow of a cargo oil in the event of damage or injury on a part of the ship body.

In addition, in a case where the mid-height deck 3 serving as a horizontal bulkhead is arranged in the cargo oil tank section as shown in FIG. 48 and FIG. 49, if a degassing means exclusively employable for replacing an inert gas in each lower cargo oil tank with fresh air after the completion of a cargo oil loading operation is disposed for each of the lower cargo oil tanks, this leads to another problem that the tanker has to be built at a substantially increased cost, because the tanker unavoidably includes many lower cargo oil tanks.

SUMMARY OF THE INVENTION

The present invention has been made with the foregoing problems in mind.

An object of the present invention is to provide a tanker which assures that outflow of a cargo oil can sufficiently be prevented in the event of damage or injury on a part of the ship body by employing arrangement of a double-sided hull construction in order to properly deal with a large shock imparted to the ship's side wall from the outside.

Another object of the present invention is to provide a tanker which assures that outflow of a cargo oil can sufficiently be prevented in the event of damage or injury on a part of the ship bottom by appropriately determining the position where a mid-height deck is arranged to divide each cargo oil tank into an upper cargo oil tank and a lower cargo oil tank.

Still another object of the present invention is to provide a tanker including an access trunk which also serves as degassing means so that an inert gas in each lower cargo oil tank is properly replaced with fresh air by utilizing the access trunk which leads to the lower cargo oil tank.

To accomplish the above objects, there is provided according to a first aspect of the present invention a cargo oil spillage preventive type tanker, wherein a plurality of cargo oil tanks are arranged in the interior of the ship body; double-sided hull constructions are arranged on the opposite sides of the cargo oil tanks to prevent outflow of a cargo oil from the cargo oil tanks to the outside of the sip's side wall; a mid-height deck is arranged to divide each cargo oil tank into an upper cargo oil tank and a lower cargo oil tank; and the upper limit value of a height of the mid-height deck as measured from the ship bottom is determined to be less than a half of the height of each of the cargo oil tanks.

In addition, according to a second aspect of the present invention, there is provided a cargo oil spillage preventive type tanker, wherein a plurality of cargo oil tanks are arranged in the interior of the ship body; double-sided hull constructions are arranged on the opposite sides of the cargo oil tanks to prevent outflow of a cargo oil from the cargo oil tanks to the outside of the ship's side wall; a mid-height deck is substantially horizontally arranged to divide each cargo oil tank into an upper cargo oil tank and a lower cargo oil tank; and the position of the mid-height deck as seen in the direction of height as measured from the ship bottom is determined to be lower than the position at which the pressure of a cargo oil exerted on the ship bottom when each lower cargo oil tank is filled with a cargo oil to an oil level directly below the mid-height deck as measured from the ship bottom when the draft is smallest as the tanker cruises with each cargo oil tank filled with a cargo oil, i.e., the sum of the pressure derived from the dead weight of a cargo oil and the maximum pressure value set by a pressure control valve disposed on an air venting tube for the lower cargo oil tank is equalized to the pressure of sea water exerted on the ship bottom.

Additionally, according to a third aspect of the present invention, there is provided a cargo oil spillage preventive type tanker, wherein a plurality of cargo oil tanks are arranged in the interior of the ship body; double-sided hull constructions are arranged on the opposite sides of the cargo oil tanks to prevent outflow of a cargo oil from the cargo oil tanks to the outside of the ship's side wall; a mid-height deck is arranged to divide each cargo oil tank into an upper cargo oil tank and a lower cargo oil tank; and the position of the mid-height deck as seen in the direction of height as measured from the ship bottom is determined to be lower than the position and in the vicinity of the same at which the pressure of a cargo oil exerted on the ship bottom when the lower cargo oil tank is filled with a cargo oil to an oil level corresponding to the mid-height deck as measured from the ship bottom when the draft is smallest as the tanker cruises with each cargo oil tank filled with a cargo oil is equalized to the pressure of sea water exerted on the ship bottom.

Further, according to a fourth aspect of the present invention, there is provided a cargo oil spillage preventive type tanker, wherein a plurality of cargo oil tanks are arranged in the interior of the ship body; double-sided hull constructions are arranged on the opposite sides of the cargo oil tanks to prevent outflow of a cargo oil from the cargo oil tanks to the outside of the ship's side wall; a mid-height deck is slantwise arranged to divide each cargo oil tank into an upper cargo oil tank and a lower cargo oil tank; and the position of the mid-height deck having a highest height as measured from the ship bottom is determined to be lower than the position at which the sum of the pressure derived from the weight of a cargo oil exerted on the ship bottom when the lower cargo oil tank is filled with a cargo oil to an oil level in the vicinity of the highest height of the mid-height deck as measured from the ship bottom and the maximum pressure value set by a pressure control valve disposed on an air venting tube for the lower cargo oil tank is equalized to the pressure of sea water exerted on the ship bottom.

Further, according to a fifth aspect of the present invention, there is provided a cargo oil spillage preventive type tanker, wherein a plurality of cargo oil tanks are arranged in the interior of the ship body; double-sided hull constructions are arranged on the opposite sides of the cargo oil tanks to prevent outflow of a cargo oil from the cargo oil tanks to the outside of the ship body; a mid-height deck is arranged to divide each cargo oil tank into an upper cargo oil tank and a lower cargo oil tank; the position of the mid-height deck as seen in the direction of height as measured from the ship bottom is determined to be lower than the position at which the pressure of a cargo oil exerted on the ship bottom when the lower cargo oil tank is filled with a cargo oil to the oil level corresponding to the mid-height deck as measured from the ship bottom when the draft is smallest as the tanker cruises while each cargo tank is filled with a cargo oil is equalized to the pressure of a sea water; and an inner hull of each double-sided hull construction is composed of a side wall of each upper cargo oil tank and a side wall of each lower cargo oil tank.

Furthermore, according to a sixth aspect of the present invention, there is provided a cargo oil spillage preventive type tanker including a mid-height deck for dividing each cargo oil tank into an upper cargo oil tank and a lower cargo oil tank, wherein an access trunk serving also as an inert gas discharging system extending from a point on the upper deck to the lower cargo oil tank is arranged so as to allow an inert gas filled in the lower cargo oil tank to be replaced with fresh air; and an air feeding system is arranged so as to allow the lower cargo oil tank to be fed with fresh air.

With the cargo oil spillage preventive type tanker of the present invention including an access trunk to serve also as degassing means, as each lower cargo oil tank is fed with fresh air through the air feeding system, an inert gas filled in the lower cargo oil tank is discharged to the outside through the access trunk serving also as degassing means connected to the lower cargo oil tank, when the lower cargo oil tank is loaded with a cargo oil. After completion of replacement of the inert gas in the lower cargo oil tank with fresh air in the above-described manner, an operator can enter the lower cargo oil tank to perform an inspecting operation or the like, if necessary.

Other objects, features and advantages of the present invention will become apparent from reading of the following description which has been made in conjunction with the accompanying drawings.

BRIEF DESCRIPTION OF THE DRAWINGS

The present invention is illustrated in the accompanying schematic drawings wherein.

DETAILED DESCRIPTION OF THE PREFERRED EMBODIMENTS

The present invention will be described in detail hereinafter with reference to the accompanying drawings which illustrate preferred embodiments of the present invention.

Figure 1:
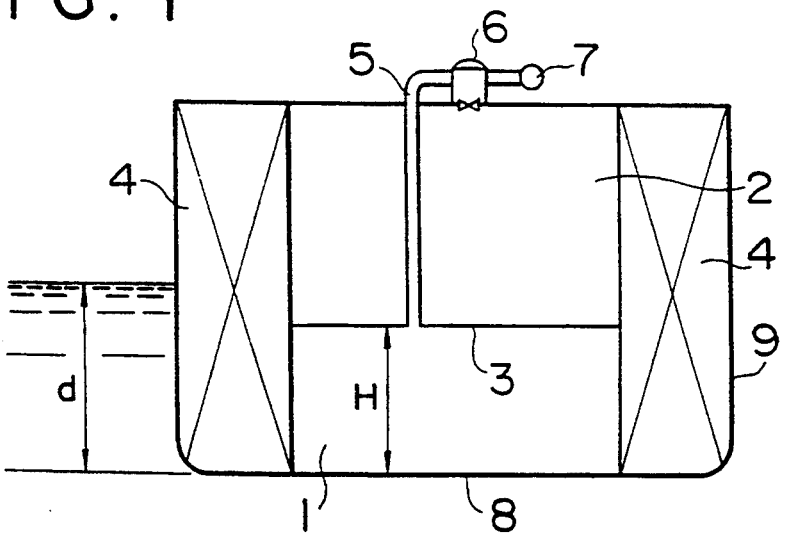
FIG. 1 is a cross-sectional view of a cargo oil spillage preventive type tanker in accordance with a first embodiment of the present invention, schematically illustrating the structure of a ship body.
Figure 2:
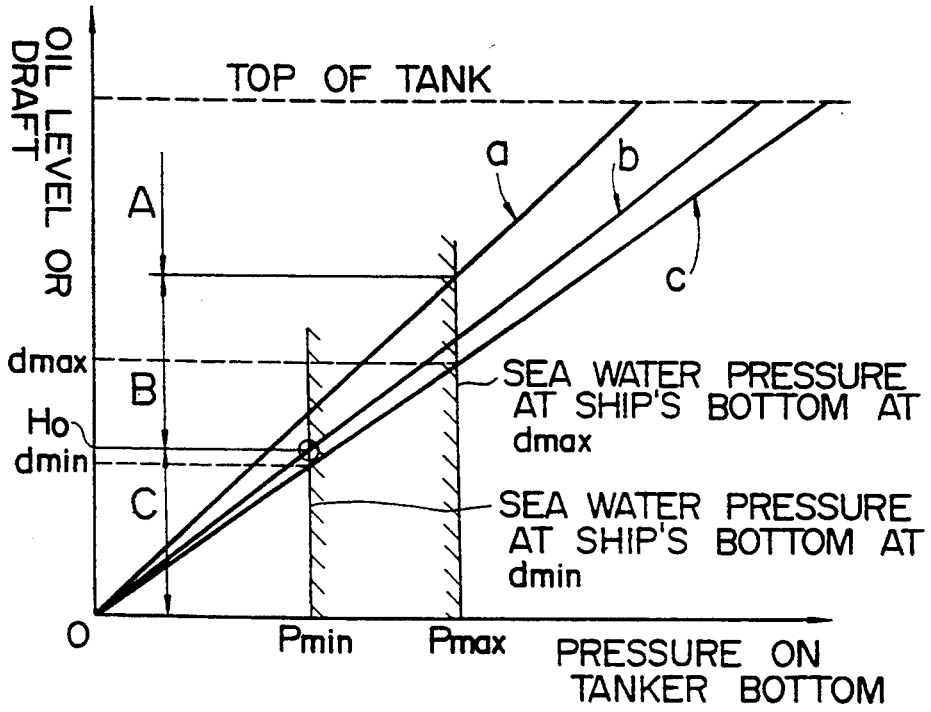
FIG. 2 is a characteristic diagram which is employable for determining the position where a mid-height deck is arranged to divide each cargo oil tank into an upper cargo oil tank and a lower cargo oil tank.

FIG. 1 is a cross-sectional view of a cargo oil spillage preventive type tanker in accordance with a first embodiment of the present invention, schematically illustrating the structure of a ship body. FIG. 2 is a characteristic diagram which illustrates a relationship between an oil level or a draft and a pressure exerted on the bottom of a cargo oil tank in FIG. 1.

As shown in FIG. 1, the tanker includes a mid-height deck 3 which divides a cargo oil tank arranged in the central region of the ship body as seen in the transversal direction into two parts, one of them being a lower cargo oil tank 1 and the other one being an upper cargo oil tank 2. As is apparent from the drawing, the mid-height deck 3 serves as a horizontal bulkhead. In addition, the tanker includes double-sided hull constructions 4 to serve as ballast tanks or hollow spaces on the opposite sides of the lower cargo oil tank 1 and the upper cargo oil tank 2.

In a case where the tanker is loaded with a cargo oil by a quantity corresponding to the height H of the mid-height deck 3 as measured from the ship bottom, the position of the mid-height deck 3 having the height H is determined to coincide with the position where the pressure of a cargo oil exerted on the ship bottom is equalized to the pressure of sea water exerted on the ship bottom or another position lower than the foregoing position and in the vicinity of the same.

In FIG. 1, reference numeral 5 designates an air ventilation tube which is communicated with the lower cargo oil tank 1, reference numeral 6 designates an inert gas hatch, reference numeral 7 designates an inert gas main tube serving also as an air ventilation main tube, reference numeral 8 designates a ship bottom, and reference numeral 9 designates a side wall of the ship.

Next, description will be given below with respect to the reason why the mid-height deck 3 effectively serves to prevent outflow of a cargo oil in the event of damage or injury on a part of the ship bottom by allowing the height of the mid-height deck 3 as measured from the ship bottom to be set to H.

Since the specific weight of a cargo oil varies depending on the kind of cargo oil, it is practically difficult to definitely determine the specific weight of a cargo oil before the tanker is built. However, it is possible to predetermine a range of specific weight of cargo oil for design purposes before the tanker is built.

When such a range is determined for design specific weights of cargo oil, the range of specific weight has a maximum value and a minimum value.

Referring to FIG. 2, a straight line a represents a relationship between the level of a cargo oil having the smallest specific weight and the pressure of a cargo oil exerted on the ship bottom (inner pressure), a straight line b represents a relationship between the level of a cargo oil having the largest specific weight and the pressure of a cargo oil exerted on the ship bottom (inner pressure) and a straight line c represents a relationship between the level of sea water (corresponding to the draft of the tanker in the shown case) and the pressure of sea water exerted on the ship bottom (outer pressure).

Here, marks in FIG. 2 will briefly be explained below.

- $d_{max}$: draft at the time when the tanker is fully loaded with a cargo oil
- $d_{min}$: smallest draft at the time when the tanker cruises while it is loaded with a cargo oil
- $H_0$: oil level at which the sea water pressure in the ship bottom in a cargo oil center tank is equalized to the cargo oil pressure in the same tank at the time when the tanker cruises with a smallest draft while it is loaded with a cargo oil having the largest specific weight among cargo oils to be loaded
- range A: height of the mid-height deck at which outflow of a cargo oil spillage occurs due to damage or injury on the ship bottom irrespective of the draft and the specific weight of a cargo oil
- range B: height of the mid-height deck at which outflow of a cargo oil can be prevented by properly limiting the draft and the specific weight of a cargo oil
- range C: height of the mid-height deck at which outflow of a cargo oil can be prevented irrespective of the draft and the specific weight of a cargo oil It should be noted that in view of the fact that there is increased probability that the mid-height deck itself is damaged or injured due to damage or injury on the ship bottom as the position of the mid-height deck is lowered toward the ship bottom more and more, it is advantageously employable that the mid-height deck is arranged at a possibly high position within the range C.

The draft of a ship varies depending on the loaded state. When an outer pressure exerted on the ship bottom with the smallest draft $d_{min}$ is designated by $P_{min}$ and an outer pressure exerted on the ship bottom with the maximum draft $d_{max}$ is designated by $P_{max}$, the relationship between $P_{max}$ and $P_{min}$ is represented by the following inequality.

$$P_{max} > P_{min} \quad (1)$$

In addition, when it is assumed that the level of a cargo oil in a cargo oil tank is designated by H and an inner pressure exerted on the ship bottom at this time is designated by P, the inner pressure P varies depending on the specific weight of a cargo oil even though the oil level H is left unchanged.

To assure that outflow of a cargo oil is reliably prevented when the ship bottom in a certain lower cargo tank 1 is damaged or injured while the tanker cruises at any draft, it is required that the inner pressure P is selectively determined such that the following inequality is established.

$$P \leqq P_{min} \quad (2)$$

The inner pressure P is definitely determined depending on the specific weight of a cargo oil as well as the level of a cargo oil. The inner pressure P assumes a larger value as the specific weight of a cargo oil increases and the level of a cargo oil is elevated.

Therefore, when the specific weight of a cargo oil is maximized, the inequality (2) is satisfactorily established and an upper limit of the level of a cargo oil is minimized. In this case, it is assumed that the level of a cargo oil is designated by $H_0$.

When the mid-height deck 3 shown in FIG. 1 is arranged at the position H lower than the position $H_0$ and the level of a cargo oil in the lower cargo oil tank 1 is restricted within the range defined by the height H of the mid-height deck 3, it is possible to prevent outflow of a cargo oil irrespective of the specific weight of a cargo oil and the draft of the tanker even though the ship bottom in the lower cargo oil tank 1 is damaged or injured. In other words, the following relationship in the form of an inequality is established between H and $H_0$.

$$H \leqq H_0 \quad (3)$$

On the other hand, with respect to a lower limit of the height H of the mid-height deck 3, when the height H is reduced near to zero, in other words, when the distance between the ship bottom and the mid-height deck 3 is reduced so as to allow them to approach each other, there is an increased probability that the mid-height deck 3 itself is damaged or injured when the ship bottom is damaged or injured due to a large magnitude of shock.

Therefore, in addition to the inequality (3), it is required that the condition represented by the following equation is established.

$$H \gtrsim H_0 \quad (4)$$

With the tanker in accordance with the first embodiment of the present invention to which the foregoing condition has been applied, outflow of a cargo oil can reliably be prevented even when the ship bottom is damaged or injured. Additionally, in a case where the ship's side wall is damaged or injured, arrangement of the double-sided hull constructions 4 assures that outflow of a cargo oil can be prevented reliably.

Figure 3:
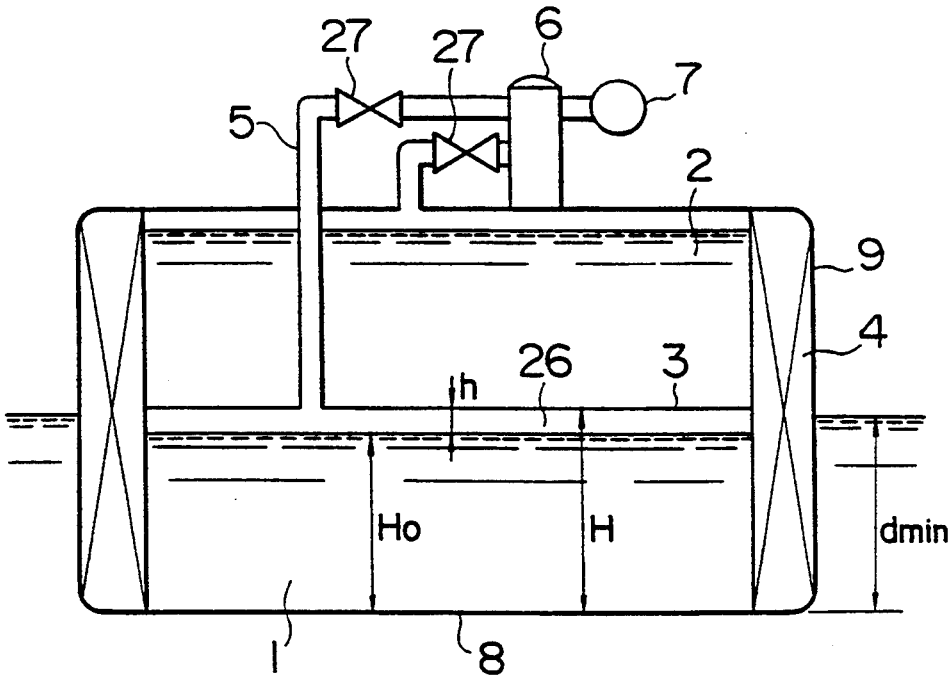
FIG. 3 is a cross-sectional view of the tanker in FIG. 1, schematically illustrating by way of example a practical usage of the tanker.

In practice, as shown in FIG. 3, the lower cargo oil tank 1 is not fully filled with a cargo oil until the oil level is elevated to the mid-height deck 3, and a hollow space 26 remains between the oil level and the mid-height deck 3. An inert gas is filled in the hollow space 26 in the pressurized state. If the pressure induced by the gravity force of a cargo oil only is designated by $P_c$, a pressure of the inert gas (i.e., a maximum set value of pressure set by a pressure control valve 27 disposed on the air venting tube 5 communicated with the lower cargo oil tank 1 from the viewpoint of designing) is designated by $P_1$, and a height of the hollow space 26 is designated by h, then the aforementioned inequalities (2), (3) and (4) are represented as follows.

$$P = P_c + P_1 \leqq P_{min} \quad (5)$$

$$H \leqq H_0 + h \quad (6)$$

$$H \approx H_0 + h \quad (7)$$

Here, if the specific gravity of sea water is designated by $S_{sw}$ and the specific weight of a cargo oil is designated by $S_0$, the height H of the mid-height deck 3 is determined in accordance with the following inequality.

$$H \leqq S_{sw}/S_0 \cdot (d_{min} - P_1/S_{sw}) + h \quad (8)$$

Next, an example of practical designing will be described below with reference to FIG. 3. When it is assumed that the specific weight of sea water is 1.025, the maximum value of the specific weight of a cargo oil is 0.9, the width of fluctuation of an inert gas pressure remains within a range from 1.4 mAq (a maximum pressure value set by the pressure control valve 27) to −0.5 mAq (a minimum pressure value set by the pressure control valve 27), the width of the tanker is 58 m, the width of each double-sided hull construction 4 is 5.8 m, the height of the ship body is 31.5 m, the maximum draft $d_{max}$ is 20.6 m and a minimum draft $d_{min}$ is 14.2 m, then the height H of the mid-height deck 3 in the lower cargo oil tank 1 is represented in the following manner.

(a) If the pressure of the inert gas is equal to the atmospheric pressure +1.4 mAq, $$H \leqq 1.025/0.9 \cdot (14.2 - 1.4/1.025) + h = 14.6 \text{ m} + h \quad (9)$$

(b) If the pressure of the inert gas is equal to the atmospheric pressure, $$H \leqq 1.025/0.9 \cdot 14.2 + h + 16.2 \text{ m} + h \quad (10)$$

(c) If the pressure of the inert gas is equal to the atmospheric pressure −0.5 mAq, $$H \leqq 1.025/0.9 \cdot (14.2 + 0.5/1.025) + h = 16.7 \text{ m} + h \quad (11)$$

As the tanker cruises with the lower cargo oil tank 1 substantially fully loaded with a cargo oil, the height h of the upper hollow space 26 in the lower cargo oil tank 1 should normally remain within a range of 1.5 m to 0.3 m, preferably lower than 1 m. This means that it is acceptable that the height H of the mid-height deck 3 is equal to or less than 15.6 m, which is the value calculated for the case where the inert gas pressure $P_1$ is maximized while the tanker cruises (the maximum pressure value set by the pressure control valve 27 disposed on the air venting tube 5).

Consequently, the height H of the mid-height deck 3 can be a half of that of the lower cargo oil tank 1 or less.

It should be noted that the height h of the upper hollow space 26 varies every time when the tanker cruises. For this reason, it is safer that the height H of the mid-height deck 3 is determined on the assumption that the height h of the upper hollow space 26 in the lower cargo oil tank 1 is zero. As a result, the height H of the mid-height deck 3 is 14.6 m or less based on the inequality (9).

Even in a case where the height H of the mid-height deck 3 is determined in the above-described manner on the assumption that the height h of the upper hollow space 26 is zero, a loading operation is performed so as to leave some upper hollow space 26 in the lower cargo oil tank 1 when the lower cargo oil tank 1 is to be fully loaded with a cargo oil. While the foregoing conditions are maintained, the relationship between the pressure of a cargo oil exerted on the ship's bottom plate and the pressure of sea water is represented by the following inequality.

$$P < P_{min} \quad (12)$$

In a case where the ship's bottom in the lower cargo oil tank 1 is damaged or injured while the foregoing conditions are maintained, sea water flows into the lower cargo oil tank 1 based on the relationship represented by the inequality (12), and the inflow of sea water continues until the pressure balance represented by the following equation is attained. Since the specific weight of sea water is larger than the specific weight of a cargo oil, the sea water in the lower cargo oil tank 1 builds a layer on the bottom of the lower cargo oil tank 1.

$$P = P_c + P_s + P_1 = P_{min} \quad (13)$$

In the above equation, $P_s$ designates a pressure derived from the weight of sea water in the sea water layer of the sea water which has entered the lower cargo oil tank 1.

The sea water layer serves to effectively suppress the movement of the ship body caused by a series of rushing waves after a part of the ship bottom is damaged or injured. In addition, the sea water layer effectively prevents secondary outflow of a cargo oil through the hole or crack which has been formed by damage or injury on the ship bottom due to the stream of sea water.

In addition, in a case where a lower limit value of the height H of the mid-height deck 3 is set to a lowest reference value of the height of a double-sided hull construction which has been hitherto specified for preventing outflow of a cargo oil due to damage or injury on a part of the ship bottom, i.e., smaller of either 1/15 of a width of the ship body or 2 meters, there is an increased probability that damage or injury expands upwardly to the mid-height deck 3 when the ship bottom is damaged or injured by a large shock. In view of the increased probability as mentioned above, the lower limit value of the height H of the mid-height deck 3 should be set to a value higher than the lowest reference value. It is preferable that it is set to a value corresponding to the draft line as the tanker cruises in the ballast-loaded state.

Figure 4:
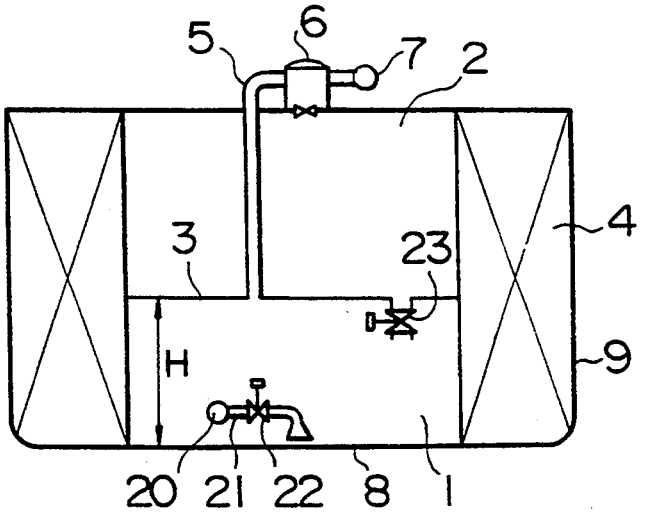
FIG. 4 is a cross-sectional view of a cargo oil spillage preventive type tanker in accordance with a second embodiment of the present invention, schematically illustrating the structure of a ship body.

Next, FIG. 4 is a cross-sectional view of a cargo oil spillage preventive type tanker in accordance with a second embodiment of the present invention, particularly illustrating the structure of the ship body.

The tanker in accordance with the second embodiment of the present invention is substantially same as the tanker in accordance with the first embodiment of the present invention in structure, with the exception that only the lower cargo oil tank 1 is equipped with a cargo oil tube unit having the same structure as that of the conventional tanker and serving as cargo oil loading means. Specifically, the cargo oil tube unit disposed in the lower cargo oil tank 1 includes a cargo oil main tube 20, a cargo oil branch tube 21 and a stop valve 22 disposed on the cargo oil branch tube 21.

In addition, a bulkhead valve 23 adapted to establish communication between the lower cargo oil tank 1 and the upper cargo oil tank 2 only at the time of a loading operation is disposed on the mid-height deck 3.

According to the second embodiment of the present invention, since the lower cargo oil tank 1 and the upper cargo oil tank 2 are communicated with each other on completion of a loading operation, the air venting tube 5 communicated with the lower cargo oil tank 1 is filled with a cargo oil to a height corresponding to the oil level in the upper cargo oil tank 2.

After completion of the loading operation, the bulkhead valve 23 is closed. At this time, the oil level in the air venting tube 5 communicated with the lower cargo oil tank 1 is elevated to be higher than the aforementioned oil level $H_0$. In this condition, if the ship bottom in the lower cargo oil tank 1 is damaged or injured, a cargo oil remaining between the oil level in the air venting tube 5 and the oil level $H_0$ flows out through the damaged or injured part of the ship bottom. It should be added that a quantity of outflow of a cargo oil is very small because the air venting tube 5 has a small cross-sectional area.

Further, the level of a cargo oil in the lower cargo oil tank 1 can be equalized to the height H of the mid-height deck 3 by transferring a cargo oil in the lower cargo oil tank 1 to another cargo oil tank by a quantity of the cargo oil which has entered the air venting tube 5 after a loading operation is completed and the bulkhead valve 23 is then closed, whereby outflow of a cargo oil can be prevented when the ship bottom is damaged or injured. It should be added that one of the double-sided hull constructions 4 contributes to the prevention of outflow of a cargo oil in the same manner as in a case of the first embodiment of the present invention when a side wall of the ship is damaged or injured.

Figure 5:
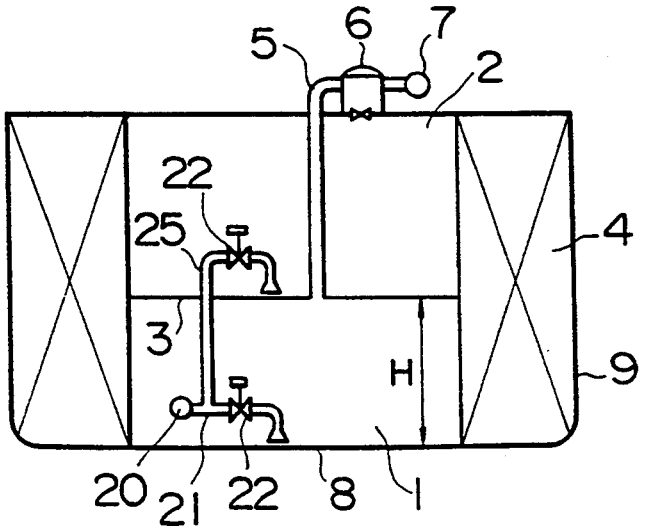
FIG. 5 is a cross-sectional view of a cargo oil spillage preventive type tanker in accordance with a third embodiment of the present invention, schematically illustrating the structure of a ship body.

Next, FIG. 5 is a cross-sectional view of a cargo oil spillage preventive type tanker in accordance with a third embodiment of the present invention, particularly illustrating the structure of a ship body.

The tanker in accordance with the third embodiment of the present invention is similar to the tanker in accordance with the first embodiment of the present invention in structure. The lower cargo oil tank 1 is equipped with a cargo oil tube unit having the same structure as that of the conventional tanker. This cargo oil tube unit serves as loading means and includes a cargo oil tube 20, a cargo oil branch tube 21 and a stop valve 22 disposed on the cargo oil branch tube 21, and moreover the upper cargo oil tank 2 is likewise equipped with loading means which includes a cargo oil branch tube 25 and a stop valve 22 which are arranged separately from those of the loading means for the lower cargo oil tank 1.

According to the third embodiment of the present invention, it is possible to separately perform a loading operation for the lower cargo oil tank 1 and the upper cargo oil tank 2. In addition, it is easy to control the level of a cargo oil such that it is elevated to the position H of the mid-height deck 3 when the lower cargo oil tank 1 is loaded with a cargo oil.

With respect to outflow of a cargo oil when the ship body is damaged or injured, the third embodiment of the present invention also assures the same functional effects as those in each of the preceding embodiments of the present invention.

It is not always required that the mid-height deck 3 extends in the exactly horizontal direction. No problems would arise, provided that the uppermost end of the mid-height deck 3 is located lower than the aforementioned height H even though it is slightly slanted.

Figure 6:
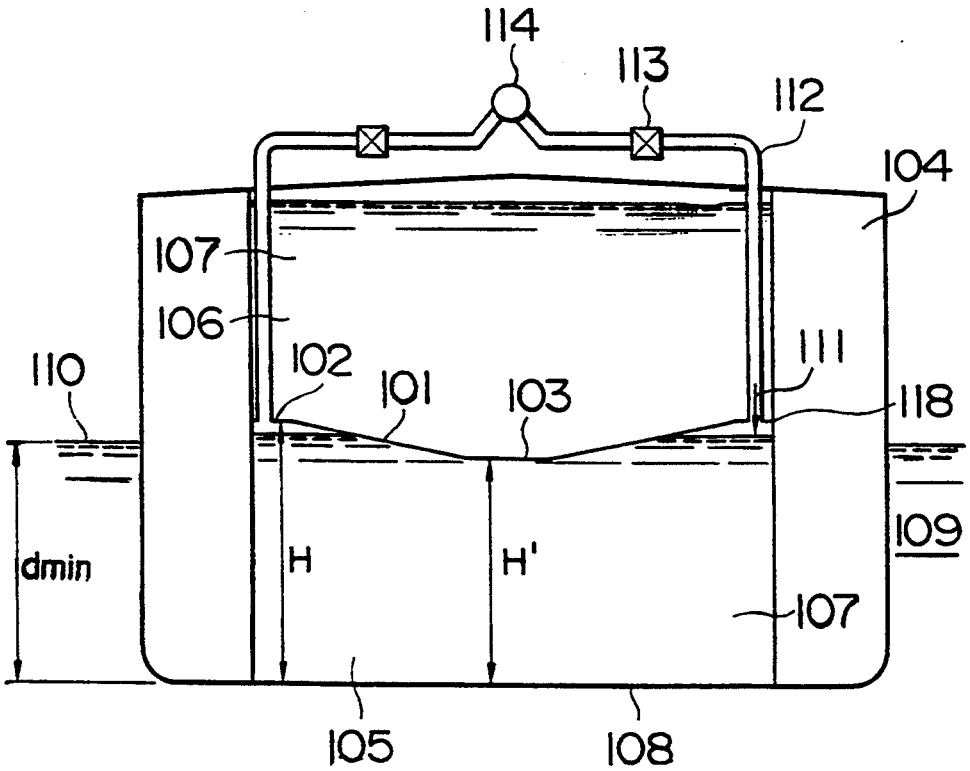
FIG. 6 is a cross-sectional view of a cargo oil spillage preventive type tanker in accordance with a fourth embodiment of the present invention, schematically illustrating the structure of a ship body.

The present invention will be described below with respect to embodiments in which the mid-height deck is slanted. In FIG. 6 and the subsequent drawings, the mid-height deck is designated by reference numeral 118.

FIG. 6 is a cross-sectional view of a cargo oil spillage preventive type tanker in accordance with a fourth embodiment of the present invention, schematically illustrating the structure of the ship body. The mid-height deck 118 is formed such that a locally flat portion 103 located at the central part of the ship body has the lowest height H' as measured from the ship bottom and the other part of the mid-height deck 118 is linearly slanted while having a height gradually increased toward the ship's side wall. In addition, the mid-height deck 118 has a locally flat highest portion 102 having the highest height H as measured from the ship bottom in the region near the joint location at which the mid-height deck is jointed to the inner hull of a double-sided hull construction 104.

If a lower cargo oil tank 105 is loaded with a cargo oil 107 by a quantity substantially corresponding to the highest position of the mid-height deck 118 as measured from the ship bottom and the tanker cruises with a smallest draft $d_{min}$ in the cargo oil loaded state, the highest height H is set to a height near to the position where a sum of the pressure derived from the weight of the cargo oil 107 exerted on the ship bottom and the highest pressure value set by a pressure control valve 113 disposed on an air venting tube 112 for the lower cargo oil tank 105 is equalized to the pressure of sea water exerted on the ship bottom.

In FIG. 6, reference numeral 101 designates a slanted portion of the mid-height deck 118, reference numeral 106 designates an upper cargo oil tank, reference numeral 107 designates a cargo oil in the upper cargo oil tank 106, reference numeral 108 designates an outer plate of the ship bottom, reference numeral 109 designates sea water, reference numeral 110 designates the surface of sea water 109, reference numeral 111 designates a gas pressure in the lower cargo oil tank 105, and reference numeral 114 designates a cargo oil tank air venting tube which also serves as an inert gas venting tube.

According to the fourth embodiment of the present invention, since the mid-height deck 118 is slanted in the above-described manner, an oil collecting operation can be performed for the cargo oil 107 in the upper cargo oil tank 106 at a high operational efficiency, and moreover a dredging operation can be performed for the upper cargo oil tank 106 at a high operational efficiency. Other advantageous effects are that the quantity of sludge deposited on the mid-height deck 118 can be reduced and the range of a sludge removing operation can be narrowed. Another advantageous effect is that degassing can smoothly be effected when the lower cargo oil tank 105 is loaded with a cargo oil.

Figure 7:
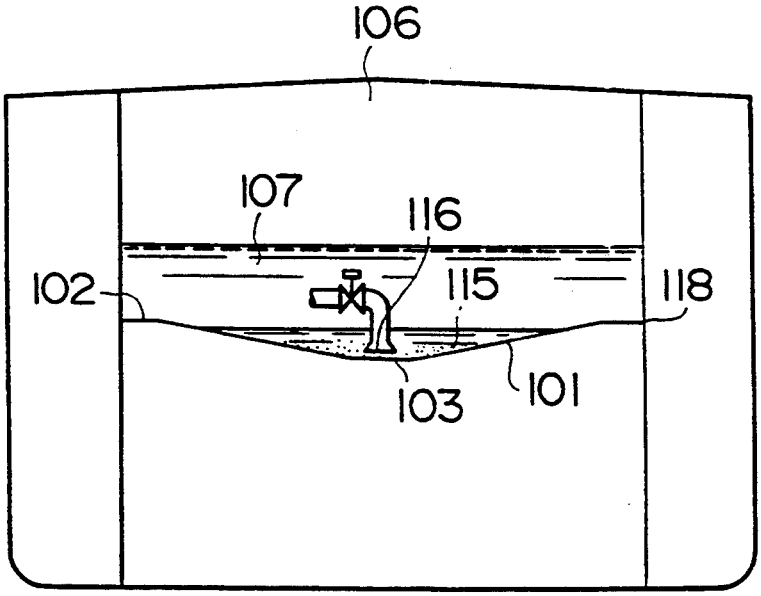
FIG. 7 is a cross-sectional view of the tanker in FIG. 6, schematically illustrating the operative state of an upper cargo oil tank.
Figure 8:
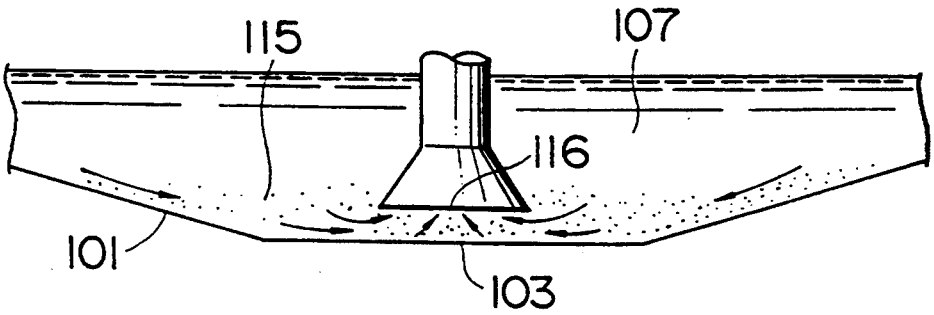
FIG. 8 is an enlarged cross-sectional view of the tanker in FIG. 7, particularly illustrating an essential part of the tanker.

FIG. 7 and FIG. 8 schematically illustrate that a sludge 115 is concentratively deposited within the range including a lowest portion 103 and surrounding slanted portions 101 of the mid-height deck 118. Especially, FIG. 8 shows the lowest portion 103 of the mid-height deck 118 inclusive of the surrounding area on an enlarged scale. As is apparent from the drawing, the sludge 115 is removed together with the cargo oil 107 by the effect of suction through the open end 116 of a suction tube when a loading operation is performed for the upper cargo oil tank 106.

Slantwise extension of the mid-height deck 118 with the central part thereof lowered relative to the ship body offers an advantage that the sludge 115 which accumulates while the tanker cruises with the upper cargo oil tank 106 loaded with a cargo oil 107 is collected at the lowest portion 103 of the mid-height deck 118, i.e., the central part of the ship body. Usually, the open end of a suction tube leading to a cargo oil tank is located at the lowest position of the cargo oil tank. For this reason, in this fourth embodiment of the present invention, it is assumed that the open end 116 of a suction tube for the upper cargo oil tank 106 is located at the lowest position of the upper cargo oil tank 106.

In view of the fact that a loading operation should be performed for the cargo oil 107 to be filled in the upper cargo oil tank 106 based on the foregoing assumption, it is natural that the sludge 115 can be removed together with the cargo oil 107 under the effect of suction at a high operational efficiency by virtue of slantwise extension of the tank bottom wall, i.e., the mid-height deck 118. It should be added that since the cargo oil 107 is always collected in the region inclusive of the open end 116 of a suction tube even when the oil level in the upper cargo oil tank 106 is lowered, a sludge removing operation can be performed at an increased operational efficiency by utilizing the effect of suction, and moreover a loading operation can be completed within a short period of time.

Usually, the sludge deposited on the bottom of a cargo oil tank is removed therefrom before a tanker enters a dock. Since the sludge 115 in the upper cargo oil tank 106 is concentratively deposited within a narrow range around the lowest position of the mid-height deck 118 as a center owing to the aforementioned slantwise extension of the mid-height deck 118, a sludge removing operation is necessary merely for the narrow range before the tanker enters a dock. In addition to the advantage that the sludge 115 can usually be removed at a high operational efficiency during a loading operation while the tanker is in operation, another advantage is that a quantity of sludge removing operations to be performed can be reduced substantially.

On the other hand, with respect to the lower cargo oil tank 105, if the mid-height deck 118 which serves as a top plate is not slanted at all, a loading operation has to be performed such that a loading rate is once lowered before completion of the loading operation. After it is confirmed that a gas in the lower cargo oil tank 105 is sufficiently removed therefrom, the loading rate is then gradually increased to finish the loading operation. Particularly, if hull members attached to the mid-height deck 118 are arranged below the mid-height deck 118, spots of collected air readily appear from place to place.

In contrast with the foregoing case, according to the fourth embodiment of the present invention, since the mid-height deck 118 is upwardly slanted toward a side wall of the ship, a gas above the oil level in the lower cargo oil tank 105 is smoothly upwardly displaced along the slanted surface of the mid-height deck 118 as the oil level is elevated during a loading operation for the lower cargo oil tank 105. Finally, the gas is discharged to the outside via gas venting tubes 112 which upwardly extend from the highest parts 102 of the mid-height deck 118. Thus, few spots of collected air appears, resulting in a loading operation being performed at a high operational efficiency.

Figure 9:
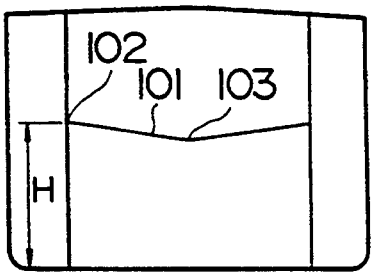
FIG. 9 is a cross-sectional view of the tanker in accordance with the fourth embodiment of the present invention, schematically illustrating by way of example a partially modified structure of the tanker.

It should be noted that FIG. 9 is a cross-sectional view of the tanker in accordance with the fourth embodiment of the present invention in FIG. 7, schematically illustrating by way of example a partially modified structure of the tanker wherein the mid-height deck includes no locally flat portion but linearly slantwise extending portions 101 are arranged between the highest parts 102 of the mid-height deck and the lowest part 103 of the same.

Figure 10:
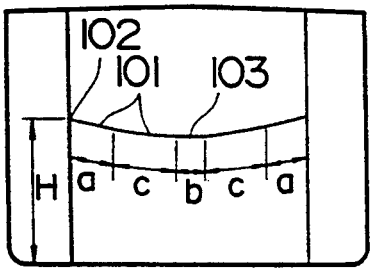
FIG. 10 is a cross-sectional view of the tanker in accordance with the fourth embodiment of the present invention, schematically illustrating another partially modified example of the tanker.

In addition, FIG. 10 is a cross-sectional view of the tanker in accordance with the fourth embodiment of the present invention in FIG. 7, schematically illustrating by way of example a partially modified structure of the tanker wherein the mid-height deck is composed of a combination of straight portions a, a locally central flat horizontal portion b and arched portions c such that slanted portions 101 are formed between the highest part 102 of the mid-height deck having the aforementioned height H and the lowest part 103 of the same.

Figure 11:
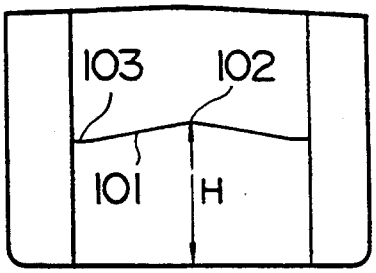
FIG. 11 is a cross-sectional view of a cargo oil spillage preventive type tanker in accordance with a fifth embodiment of the present invention, schematically illustrating the structure of a ship body.
Figure 12:
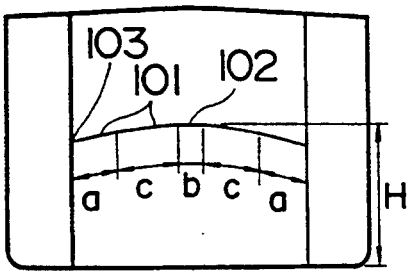
FIG. 12 is a cross-sectional view of the tanker in FIG. 11, schematically illustrating by way of example a partially modified structure of the tanker.

Next, FIG. 11 and FIG. 12 are a cross-sectional view of a cargo oil spillage preventive type tanker in accordance with a fifth embodiment of the present invention, schematically illustrating the structure of the ship body in which the highest part 102 of the mid-height deck having the aforementioned height H is arranged at the central part of the ship body. The tanker in accordance with the fifth embodiment of the present invention assures the same functional effects as those of the tanker in accordance with the fourth embodiment of the present invention.

In FIG. 12, reference character a designates a straight portion, reference character b designates a locally central flat horizontal portion and reference character c designates an arched portion in the same manner as those in FIG. 10.

Figure 13:
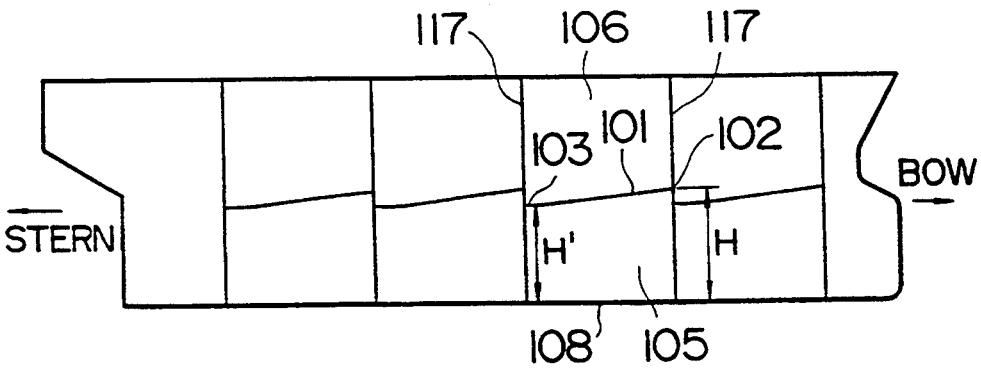
FIG. 13 is a vertical cross-sectional view of a cargo oil spillage preventive type tanker in accordance with a sixth embodiment of the present invention as seen in the longitudinal direction, schematically illustrating the structure of a ship body.
Figure 14:
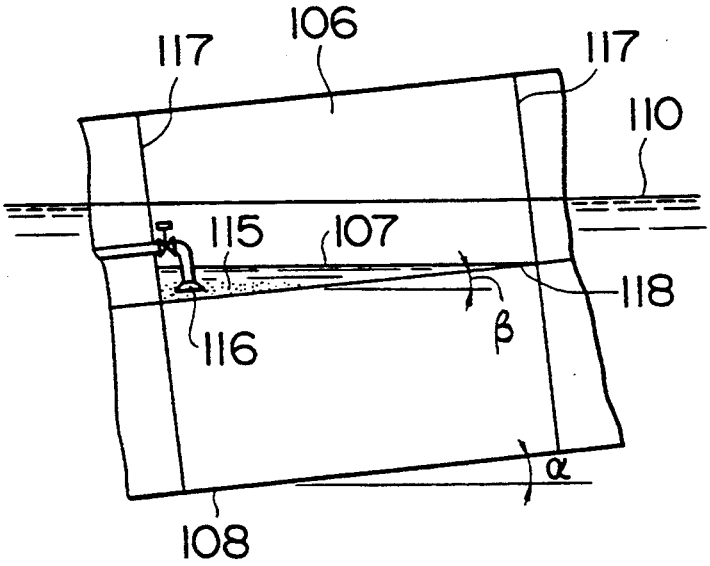
FIG. 14 is a vertical cross-sectional view of a conventional tanker, schematically illustrating essential components constituting the tanker which is held in the inclined state.
Figure 15:
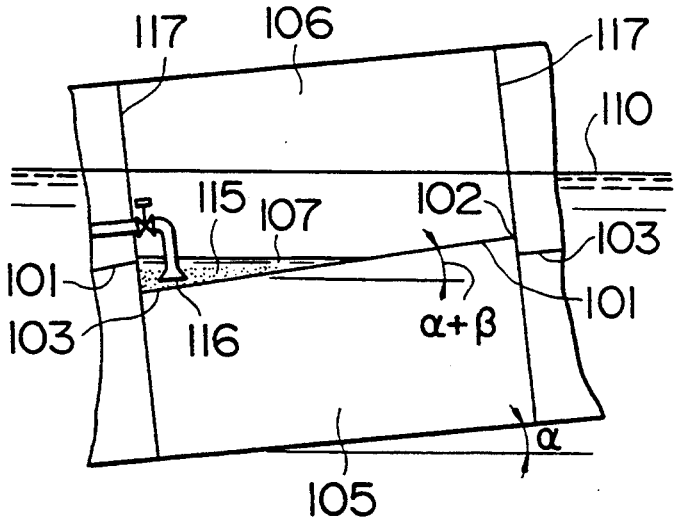
FIG. 15 is a vertical cross-sectional view of the tanker in accordance with the six embodiment of the present invention similar to FIG. 14, schematically illustrating essential components constituting the tanker held in the inclined state in comparison with those in FIG. 13.

Next, FIG. 13 to FIG. 15 show a cargo oil spillage preventive type tanker in accordance with a sixth embodiment of the present invention in which the mid-height deck 118 is slanted in the longitudinal direction within the range of each upper cargo oil tank 106 such that it has a highest height H at the foremost end on the bow side while it has a lowest height H at the rearmost end on the stern side. It should be noted that the lowest part 103 of the mid-height deck 118 has a fragmentary flat portion. In the drawings, reference numeral 117 designates a transversally extending bulkhead, an alpha designates a trim angle and a beta designates a slant angle of the mid-height deck 118 in the longitudinal direction of the ship body.

FIG. 15 is a cross-sectional view of the tanker which illustrates the state of the remaining cargo oil 107 and a sludge 115 in an upper cargo oil tank 106 just before completion of a loading operation for the upper cargo oil tank 106 while the tanker is held in the trimmed state during the loading operation, in comparison with a case where the mid-height deck 118 is not slanted in the longitudinal direction as shown in FIG. 14.

According to the sixth embodiment of the present invention, as shown in FIG. 15, the tanker is inclined such that the mid-height deck 118 assumes a large angle relative to the horizontal plane by a quantity of the slant angle $\beta$ compared with the case shown in FIG. 14, even though the tanker is held with the same trim angle $\alpha$. In addition, as is apparent from FIG. 15, the cargo oil 107 and the sludge 115 are easily collected in a region near the open end 116 of a suction tube by a quantity corresponding to the enlarged slant angle of the mid-height deck 118. Consequently, a loading operation can be performed at a high operational efficiency and the sludge 115 can easily be removed from the upper cargo oil tank 106 at an improved operational efficiency.

More specifically, a tanker is usually provided with a pump chamber at the position astern of each cargo oil tank section and thereby a suction tube rearwardly extends from the cargo oil tank to the pump chamber. For this reason, to improve a suction efficiency during a loading operation, the ship body is usually held in such an attitude that the stern side is trimmed downwardly. In this case, the bottom of each cargo oil tank is slanted such that the stern side is slantwise lowered relative to the horizontal plane corresponding to the present trimmed state of the ship body. Since the mid-height deck 118 serving as a bottom plate for the upper cargo oil tank 106 is designed to be slanted such that the stern side is lowered, the slant angle of the mid-height deck 118 relative to the horizontal plane is substantially enlarged during a loading operation by virtue of the multiplicative effect derived from the aforementioned trimmed state on the stern side. Thus, a loading operation can be performed for the upper cargo oil tank 106 at a substantially improved operational efficiency, and moreover the sludge 115 can be removed from the upper cargo oil tank 106 by the effect of suction during the loading operation at a substantially improved operational efficiency.

Figure 16:
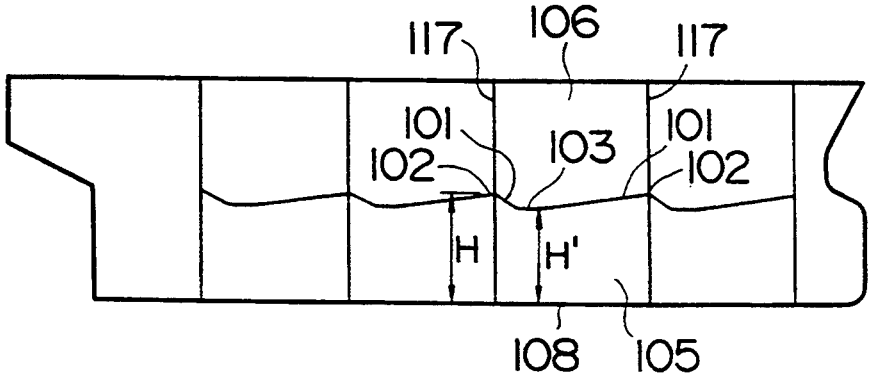
FIG. 16 is a vertical cross-sectional view of a cargo oil spillage preventive type tanker in accordance with a seventh embodiment of the present invention as seen in the longitudinal direction, schematically illustrating the structure of a ship body.

Next, FIG. 16 is a vertical sectional view of a cargo oil spillage preventive type tanker in accordance with a seventh embodiment of the present invention as seen in the longitudinal direction of the ship body in which the mid-height deck is formed such that it includes a locally horizontal lowest portion 103 at the intermediate location of each upper cargo oil tank 106 as seen in the longitudinal direction of the ship body within the range of the upper cargo oil tank 106, it includes linearly extending portions 101 each gradually rising in the ahead direction as well as in the astern direction, and it includes a highest portion 102 having the aforementioned highest height H at the joint location where the mid-height deck is jointed to a transversally extending bulkhead 117. It should be noted that the lowest portion 103 is located at the position slightly rearward of the central part of the upper cargo oil tank 106 as seen in the longitudinal direction of the ship body.

The tanker in accordance with the seventh embodiment of the present invention has the substantially same functional effects as those of the tanker in accordance with the sixth embodiment of the present invention. In addition, since the mid-height deck is formed such that the intermediate part is lowered and the fore and rear end parts are elevated as seen in the longitudinal direction, it is possible that the position of the fore end of the mid-height deck as seen in the vertical direction coincides with the position of the rear end of the same, irrespective of any position at which the lowest portion 103 is selectively located in the longitudinal direction. Therefore, with respect to a series of upper cargo oil tanks successively arranged in the longitudinal direction, the height of the rear end of the mid-height deck ahead of the transversally extending bulkhead 117 can be equalized to the height of the fore end of the mid-height deck astern of the transversally extending bulkhead 117. This leads to the result that reliability of the tanker in respect of structural strength can be improved, and moreover economical properties of the tanker represented by the reduction of a total weight of steel materials consumed for building the tanker and easiness of building operations to be performed for the tanker can be improved.

Figure 17:
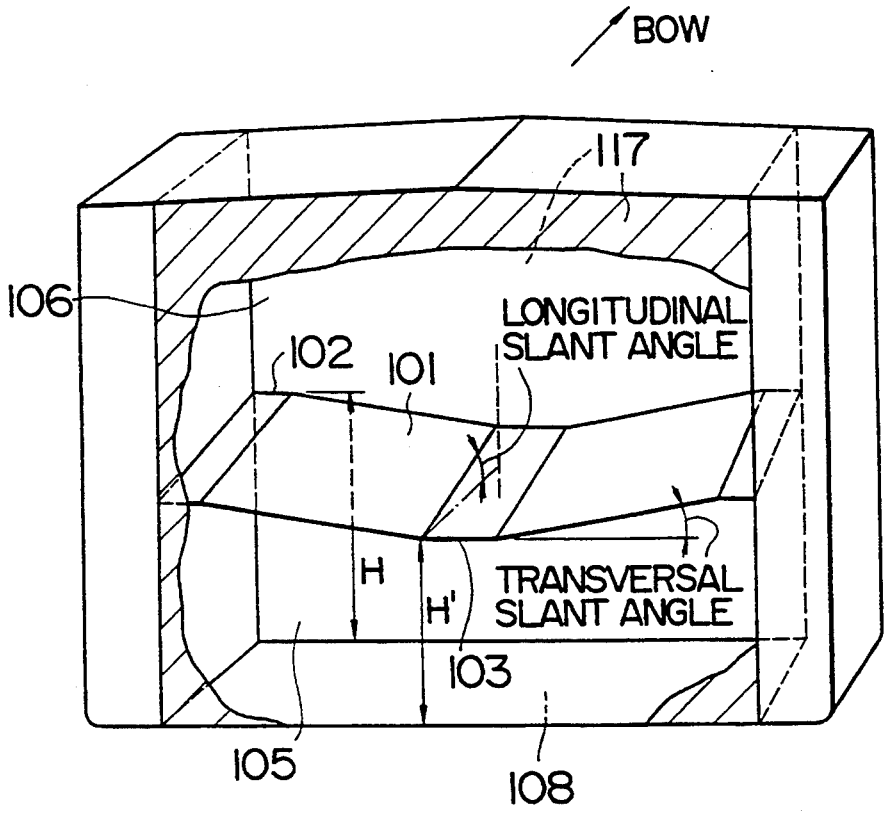
FIG. 17 is a perspective cross-sectional view of a cargo oil spillage preventive type tanker in accordance with an eighth embodiment of the present invention, schematically illustrating essential components constituting the tanker.

Next, FIG. 17 is a perspective view of a cargo oil spillage preventive type tanker in accordance with an eighth embodiment of the present invention in which the mid-height deck is linearly slanted in the longitudinal direction and it has the same configuration in the transversal direction of the ship body as that shown in FIG. 6. Specifically, the mid-height deck is formed such that it is lowered along the center line of the ship body, it includes straight portions 101 each gradually slantwise rising toward a side wall of the ship and it includes flat plate-shaped portions at the opposite ends thereof as seen in the transversal direction.

In addition, the mid-height deck includes a highest portion 102 having the aforementioned highest height H on the bow side and it includes a lowest portion 103 at the central part thereof on the stern side.

According to the eighth embodiment of the present invention, since the slantwise extension of the mid-height deck in the transversal direction is combined with the slantwise extension of the same in the longitudinal direction, the mid-height deck has a single narrow lowest portion 103 having a lowest height as measured along the bottom surface of the upper cargo oil tank 106. Thus, a cargo oil and a sludge in the upper cargo oil tank 106 is concentratively collected at the lowest portion 103 along the slantwise extension of the mid-height deck in the longitudinal direction as well as the slantwise extension of the same in the transversal direction of the ship body, resulting in an efficiency of a cargo oil loading operations and an efficiency of sludge removing operations being improved substantially.

Next, FIG. 18 to FIG. 24 show a cargo oil spillage preventive type tanker in accordance with a ninth embodiment of the present invention in which an inner hull 119 of each double hull construction 104 is formed by a combination of the side wall of an upper cargo oil tank and the side wall of a lower cargo oil tank.

In addition, the inner hull 119 is formed by a vertical flat plate continuously extending in the vertical direction across the upper cargo oil tank and the lower cargo oil tank.

Figure 25:
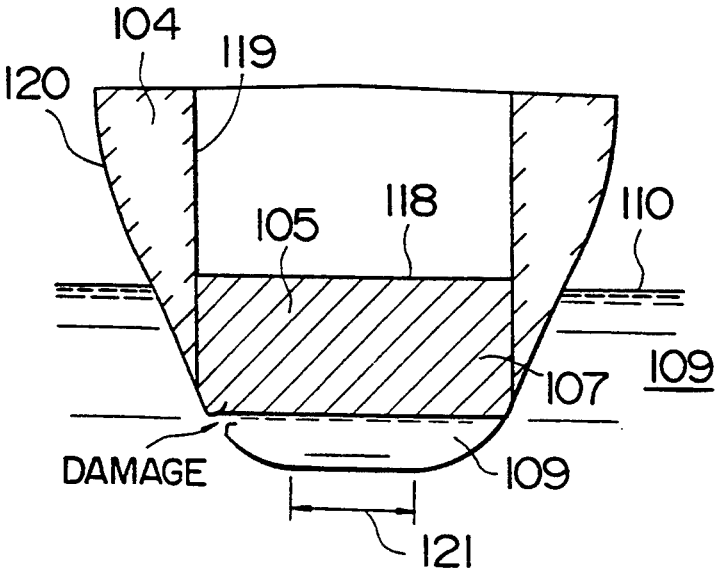
FIG. 25 is a cross-sectional view of the ship body, schematically illustrating by way of example a malfunction in the event of damage or injury on a part of the bottom portion of the ship's side wall.

As shown in FIG. 25, an outer plate constituting a side wall of the ship downwardly converges toward the center of the ship body in the narrow-width part located ahead of a cargo oil tank section as well as astern of the same, and the range of a flat portion 121 for the outer plates each constituting a side wall of the ship is gradually slantwise narrowed. If the inner hull 119 of the double-sided hull construction 104 is arranged such that it extends on a common plane of the inner hull at the central part of the ship body, it cannot provide a double-sided hull construction, as shown in FIG. 25. In other words, a part of the outer plate constituting a side wall of the ship fails to provide a double-sided hull construction. With such a bulkhead construction, there is a possibility that outflow of a cargo oil occurs due to slight damage or injury on a part of the bottom wall of the ship body, i.e., an extension from a side wall.

FIG. 25 is a cross-sectional view of the tanker, schematically illustrating outflow of a cargo oil in the event of damage or injury on a part of the bottom wall in the aforementioned side wall region of the ship body.

Figure 18:
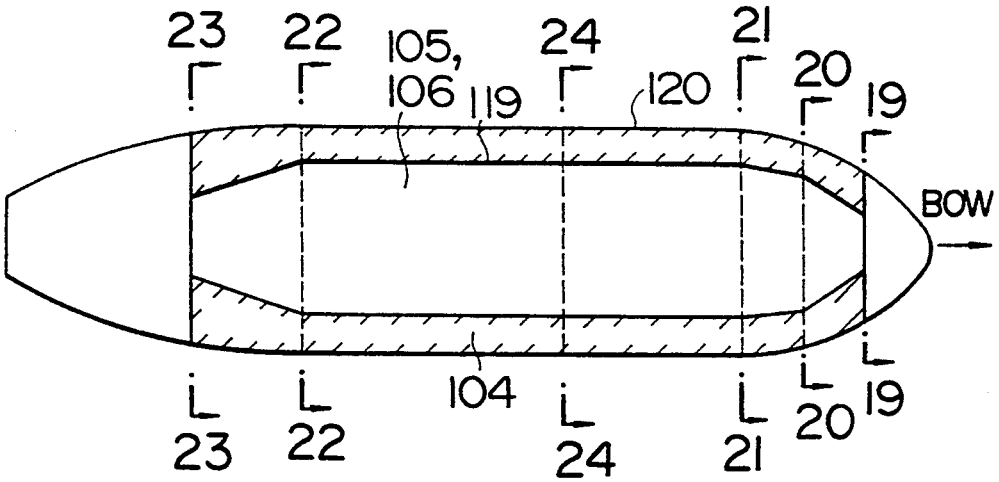
FIG. 18 is a horizontal cross-sectional view of a cargo oil spillage preventive type tanker in accordance with a ninth embodiment of the present invention, schematically illustrating the structure of a ship body.
Figure 19:
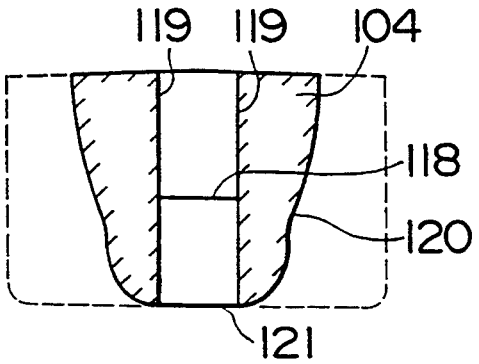
FIG. 19 is a cross-sectional view of the tanker taken along line 19—19 in FIG. 18.
Figure 20:
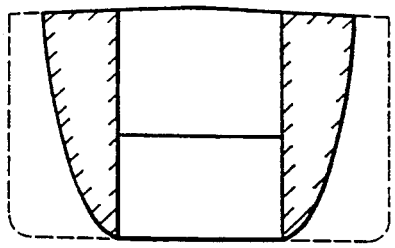
FIG. 20 is a cross-sectional view of the tanker taken along line 20—20 in FIG. 18.
Figure 21:
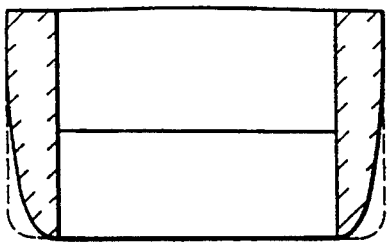
FIG. 21 is a cross-sectional view of the tanker taken along line 21—21 the in FIG. 18.
Figure 22:
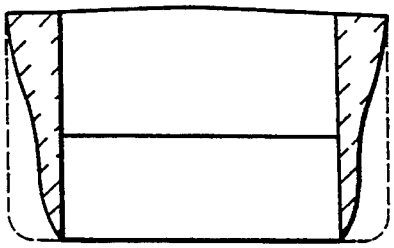
FIG. 22 is a cross-sectional view of the tanker the D in FIG. 18.
Figure 23:
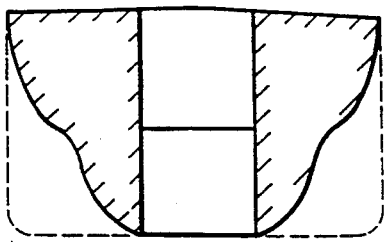
FIG. 23 is a sectional view of the tanker as seen in taken along line 23—23 in FIG. 18.
Figure 24:
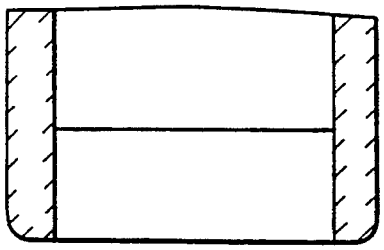
FIG. 24 is a cross-sectional view of the tanker taken along line 24—24 in FIG. 18.

According to the ninth embodiment of the present invention, to prevent outflow of cargo oil in the side wall region of the ship body, opposite inner hulls 119 formed by vertical flat plates are bent toward the central line of the ship body on the bow side as well as on the stern side as seen in a plan view, as shown in FIG. 18.

In addition, according to the ninth embodiment of the present invention, since flat plates continuously extending in the vertical direction are employed for the inner hull of each double-sided hull construction, a double-sided hull construction block can be formed in a regular hexahedral configuration within the range where the outer plate constituting a side wall of the ship maintains still the shape of a vertical flat plate with the exception of a bilge portion on the bottom wall extending from the side wall.

At present, a commonly employed method of building a ship is by the steps of dividing a ship body into several blocks, fabricating each divided block in a block assembling factory and then successively jointing the blocks to each other on a dock or a building slip.

When each block is fabricated in the regular hexahedral configuration, an assembling operation can easily be performed for successively jointing a plurality of blocks to each other, an automation unit can readily be employed for the purpose of building a ship and moreover a machining/working accuracy can be controlled easily. Therefore, as long as each double-sided hull construction block is fabricated in the regular hexahedral configuration in accordance with the ninth embodiment of the present invention, easiness of building a ship and an operational efficiency of building the same can be improved, and moreover economical properties associated with building a ship can be improved.

With respect to the narrow-width part of an outer plate constituting a side wall of the ship ahead of a cargo oil tank section as well as astern of the same, since the inner hull of each double-sided hull construction is bent toward the center line of the ship body while maintaining the vertical plate unchanged at the central region of the ship body, the lower end of the vertical plate can be jointed to the flat part of the outer plate in the bottom region at all times. As a result, undesirable outflow of a cargo oil due to damage or injury on the outer plate in the bottom region of the ship body as shown in FIG. 25 can be avoided reliably.

Additionally, since the inner hull is constructed by vertical flat plates, a machining/working operation can be performed with the vertical flat plates as a reference surface when blocks are assembled together or they are successively jointed to each other, making tanker building easy.

Figure 26:
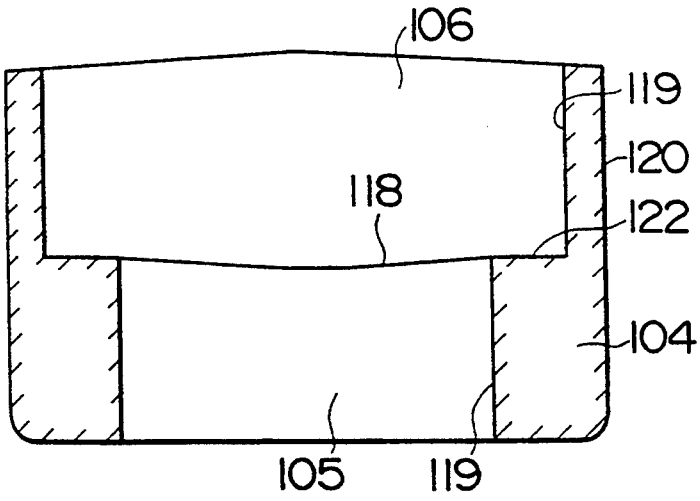
FIG. 26 is a cross-sectional view of a cargo oil spillage preventive type tanker in accordance with a tenth embodiment of the present invention, schematically illustrating the structure of a ship body.
Figure 27:
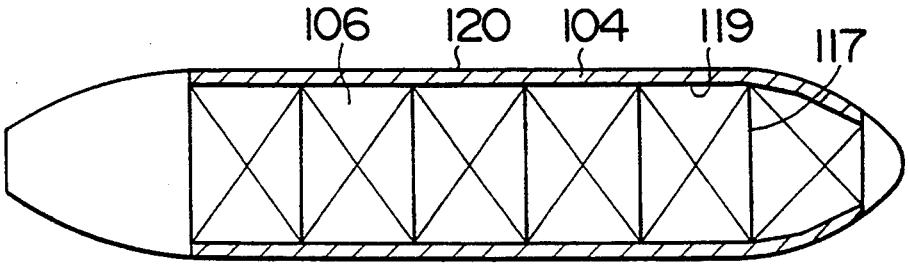
FIG. 27 is a horizontal cross-sectional plan view of the tanker in FIG. 26, schematically illustrating arrangement of upper cargo oil tanks.
Figure 28:
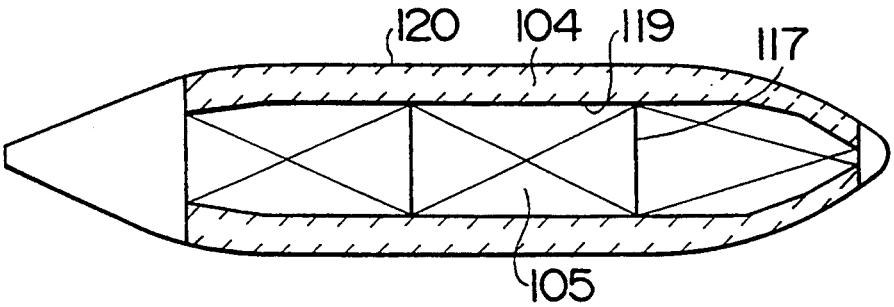
FIG. 28 is a horizontal cross-sectional plan view of the tanker in FIG. 26, particularly illustrating arrangement of lower cargo oil tanks.
Figure 29:
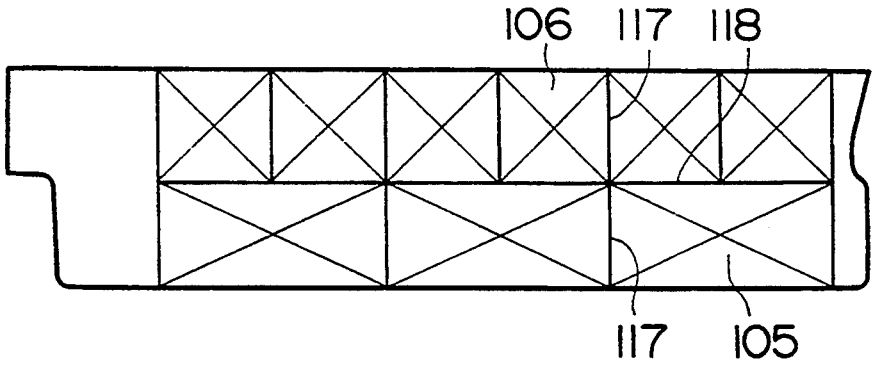
FIG. 29 is a vertical cross-sectional view of the tanker in FIG. 26 taken along a center line of the ship body in the longitudinal direction.

Next, FIG. 26 to FIG. 29 show a cargo oil spillage preventive type tanker in accordance with a tenth embodiment of the present invention. FIG. 26 is a cross-sectional view of the tanker at the central part of a ship body as seen in the transversal direction, FIG. 27 is a sectional plan view of the tanker, particularly illustrating arrangement of a plurality of upper cargo oil tanks, FIG. 28 is a sectional plan view of the tanker, particularly illustrating arrangement of a plurality of lower cargo oil tanks, and FIG. 29 is a vertical sectional view of the tanker taken along a center line of the ship body in the longitudinal direction, particularly illustrating arrangement of the upper and lower cargo oil tanks.

According to the tenth embodiment of the present invention, the configuration of a mid-height deck 118 as shown in FIG. 6 is employed for the tanker, in which an inner hull 119 of each double-sided hull construction 104 is formed by the combination of a vertical flat plate and a horizontal flat plate. Specifically, the range where the inner hull 119 comes in contact with the side wall of an upper cargo oil tank 106 is formed by the vertical flat plate which is located in the vicinity of an outer plate 120 constituting a side wall of the ship, the horizontal flat plate 122 is arranged in the region of the mid-height deck 118, and the range where the inner hull 119 comes in contact with the side wall of a lower cargo oil tank 105 is formed with the vertical flat plate which is located remote from the outer plate 120 of the side wall of the ship.

When a side wall of the ship is damaged or injured due to collision with some obstacle or the like, the double-sided hull construction 104 can prevent outflow of a cargo oil, unless the inner hull 119 is damaged or injured. However, when the collision takes place with a large magnitude of energy, the inner hull 119 may be damaged or injured. The greater the thickness (width) of the double-sided hull construction 104, the less the probability that the inner hull 119 will be damaged or injured. However, if the double-sided hull construction 104 is designed such that it has a large thickness over the whole surface of a cargo oil tank section, this leads to the result that an available volume of each cargo oil tank reduced for a given size of the tanker. On the contrary, if the available volume of each cargo oil tank is kept constant, this leads to the result that the tanker has to have larger dimensions. The interior of each double-sided hull construction 104 is usually utilized as a ballast tank. In practice, however, an inner available volume of each double-sided hull construction 104 is determined to be excessively large in consideration of a quantity of ballast required when the tanker cruises. This leads to the result that some of the double-sided hull constructions 104 become useless sections which are not required for allowing the tanker to cruise.

In view of the foregoing fact, when a thickness of the double-sided hull construction 104 is determined such that a part which is readily damaged or injured in the event of collision or a part from which a large quantity of cargo oil flows out when the inner hull 119 is damaged or injured is dimensioned to have a greater thickness, an effect for preventing outflow of a cargo oil can be enhanced substantially. In addition, with such dimensioning as mentioned above, it becomes possible to minimize useless space in the interior of each double-sided hull construction 104, and moreover effectively maintain an available volume of each cargo oil tank. As a result, the tanker is built in a small size having possibly reduced dimensions with improved economical properties.

With respect to the lower cargo oil tanks 105, each double-sided hull construction 104 is dimensioned to have a greater thickness within the aforementioned dangerous region. With such dimensioning, each lower cargo oil tank 105 has excellent safety in the event of damage or injury to the ship's side wall. Therefore, as is apparent from FIG. 27, FIG. 28 and FIG. 29, the lower cargo oil tanks 105 have a reduced number of transversally extending bulkheads 117 arranged between the adjacent cargo oil tanks compared with the upper cargo oil tanks 106. In other words, the number of lower cargo oil tanks 105 is reduced to a half of the number of upper cargo oil tanks 106.

According to the tenth embodiment of the present invention, the tanker is built by utilizing the technical concept disclosed in connection with the ninth embodiment of the present invention. Specifically, the foregoing technical concept is utilized as means for varying a thickness of each double-sided hull construction 104 in the vertical direction by employing a combination of the vertical plates with the horizontal plate which makes it easier to fabricate them. With the foregoing means, e.g., when the double-sided hull constructions in the region of the upper cargo oil tanks 106 are dimensioned to have a thin thickness and the double hull constructions in the region of the lower cargo oil tanks 105 are dimensioned to have a sufficiently heavy thickness, the lower cargo oil tanks 105 are not damaged or injured even in the event of damage or injury on a part of the ship's side wall due to collision because each double-sided hull construction 104 has a sufficiently large thickness. Since the lower cargo oil tanks 105 have excellent safety in respect of outflow of a cargo oil not only in the event to damage or injury of the ship's side wall but also in the event to damage or injury of the ship bottom wall, an available volume for each tank can be enlarged. With respect to the lower cargo oil tanks 105, it is difficult to perform a sludge removing operation, a degassing operation, an inspecting operation mainly for the interior thereof and a maintenance service compared with the upper cargo oil tanks 106.

Therefore, when each lower cargo oil tank 105 is enlarged in dimension and the number of tanks is reduced based on the aforementioned means, the number of auxiliary instruments and equipments to be mounted in each cargo oil tank can be reduced and a quantity of maintenance services to be performed can be reduced also.

On the other hand, since the upper cargo oil tanks 106 are readily damaged or injured when the ship's side wall is damaged or injured, there arises a necessity for designing each cargo oil tank in smaller dimensions. As a result, the number of tanks has to be increased, the number of auxiliary instruments and equipments to be mounted in each cargo oil tank increases and the quantity of maintenance services to be performed also increases. However, since a mounting operation for auxiliary instruments and equipments and a maintenance service are more easily performed for the upper cargo oil tanks 106 than the lower cargo oil tanks 105, it is acceptable from the viewpoint of a total amount of building operations for the tanker that the number of lower cargo oil tanks 105 is reduced and the number of upper cargo oil tanks 106 is increased. Consequently, a tanker of the aforementioned type having excellent economical properties can be built.

Further, according to the tenth embodiment of the present invention, when the ninth embodiment of the present invention is applied to the narrow-width part of the outer plate of the ship body ahead of the cargo oil tank section as well as astern of the same, there is a tendency that a width of each double-sided hull construction 104 is uselessly widened in the region above the outer plate of the ship's side wall and uselessly narrowed in the region below the same. As a result, it is unavoidably required that the double-sided hull construction section assumes an unnecessary volume. In contrast with this, the inner hull of the double-sided hull construction section can be formed to the step-shaped configuration in conformity with the configuration of the outer plate of the ship body.

Therefore, it is not required that the double-sided hull construction section assumes an unnecessary volume and the available volume of each cargo oil tank can be maintained effectively. Provided that the available volume of each cargo oil tank is kept constant, the tanker can be built in minimized dimensions with excellent economical properties by employing the tenth embodiment of the present invention.

Figure 30:
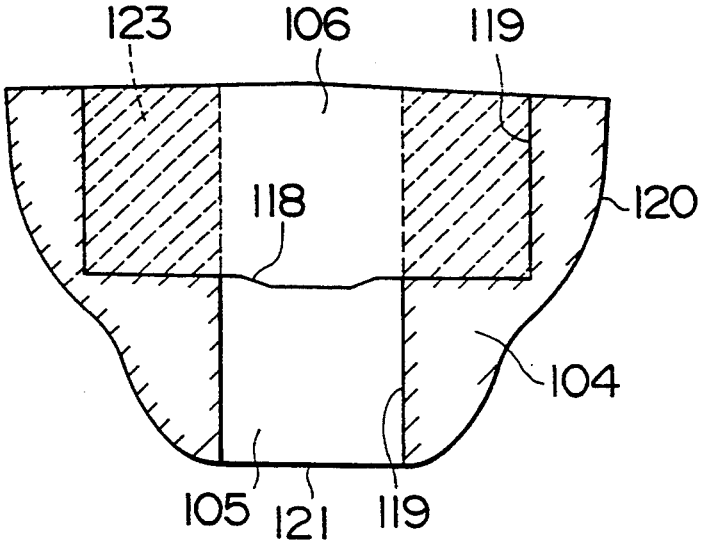
FIG. 30 is a cross-sectional view of the tanker in FIG. 26, particularly illustrating the narrow-width part of an outer plate of the ship body.

FIG. 30 is a cross-sectional view of the tanker in accordance with the tenth embodiment of the present invention, particularly illustrating a case where the technical concept shown in FIG. 26 is applied to the narrow-width part of an outer plate of the ship body ahead of the cargo oil tank section as well as astern of the same. As is apparent from FIG. 30, the configuration of an outer plate 120 of the ship's side wall in the narrow-width part of the same exhibits a smoothly curved line which extends toward the center line of the ship body along the ship bottom. As shown in FIG. 30, when an inner hull 119 is formed by the combination of vertical flat plates with a horizontal flat plate, a range 123 represented by hatching lines can effectively be utilized as an upper cargo oil tank 106 compared with a case where the inner hull 119 is formed by a single vertical flat plate only (see FIG. 23).

Figure 31:
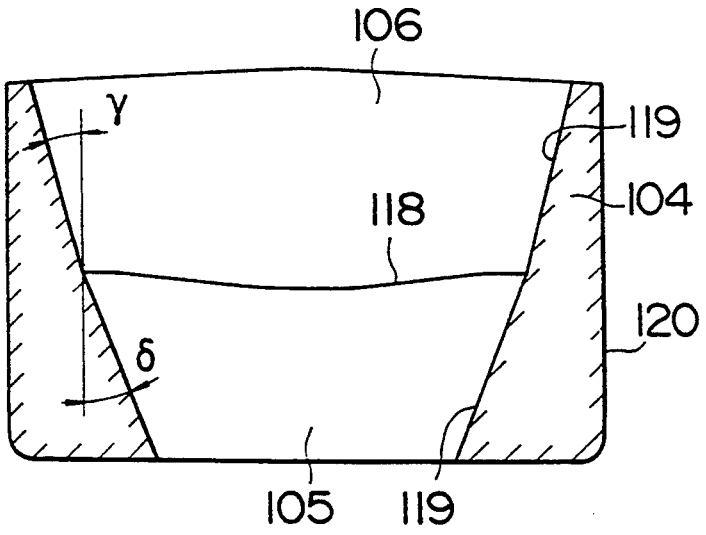
FIG. 31 is a cross-sectional view of a cargo oil spillage preventive type tanker in accordance with an eleventh embodiment of the present invention, schematically illustrating the structure of a ship body.

Next, FIG. 31 is a cross-sectional view of a cargo oil spillage preventive type tanker in accordance with an eleventh embodiment of the present invention in which a mid-height deck 118 is formed to exhibit the configuration shown in FIG. 6 and two kinds of flat plates having slant angles of $\gamma$ and $\delta$ relative to a vertical plane are employed for forming an inner hull 119 while the position where slantwise extension of the flat plates varies coincides with the intersection where the mid-height deck 118 intersects the flat plates. The angle $\delta$ is larger than the angle $\gamma$. According to the eleventh embodiment of the present invention, the position where the thickness of a double-sided hull construction 104 is minimized within the range of an upper cargo oil tank 106 coincides with the position where the double-sided hull construction 104 comes in contact with an upper deck, and the thickness of the double-sided hull construction 104 is increased more and more downward of the upper deck. Thus, when a part of the ship's side wall is damaged or injured due to collision with some obstacle, the location where the inner hull 119 is readily damaged or injured is situated in the vicinity of the upper deck where the thickness of the double-sided hull construction 104 is minimized.

When the side wall of the upper cargo oil tank 106 is damaged or injured, the quantity of outflow of a cargo oil corresponds to the quantity of the cargo oil which has been filled in the space above the lowest level of the damaged or injured part on the upper cargo oil tank 106. Therefore, when the side wall of the upper cargo oil tank 106 is damaged or injured at the possibly high position rather than the low position thereof, an effect for preventing outflow of a cargo oil can be enhanced. According to the eleventh embodiment of the present invention shown in FIG. 31, an effect for preventing outflow of a cargo oil in the event of damage or injury on the side wall of the upper cargo oil tank 106 is enhanced in consideration of the aforementioned fact.

The thickness of the double-sided hull construction 104 within the range of a lower cargo oil tank 105 is determined to be greater than that within the range of the upper cargo oil tank 106.

Figure 32:
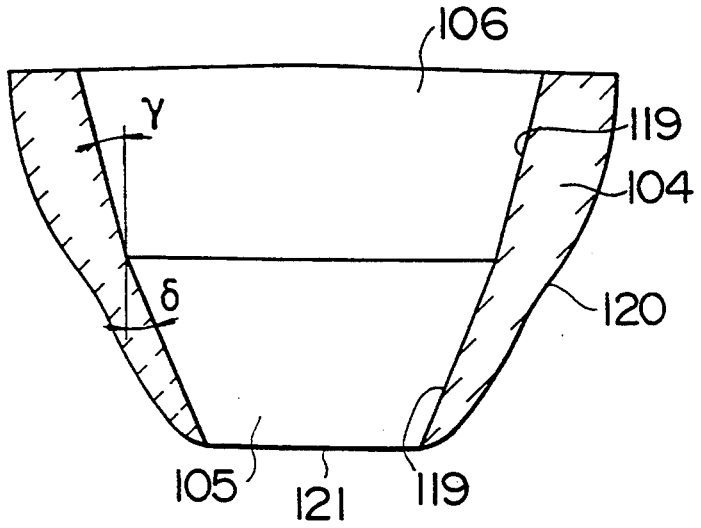
FIG. 32 is a cross-sectional view of the tanker in FIG. 31, particularly illustrating the narrow-width part of an outer plate of the ship body.

FIG. 32 is a cross-sectional view of the tanker in FIG. 31, particularly illustrating the narrow-width part of an outer plate of the ship body. Slantwise extension of the inner hull 119 and the position where the slantwise extension of the flat plates varies are the same as those in FIG. 31. According to the eleventh embodiment of the present invention, an available volume of each of the upper cargo oil tank 106 and the lower cargo oil tank 105 can be maintained in the narrow-width part of the outer plate of the ship body in conformity with the configuration of an outer plate 120 of the ship's side wall more effectively than those in the embodiment shown in FIG. 30.

According to the eleventh embodiment of the present invention, the combination of two slantwise extending flat plates in conformity with the given configuration of the inner hull 119 is utilized as means for varying the thickness of each double-sided hull construction which has been described above with reference to the tenth embodiment of the present invention. It is obvious that the foregoing means can easily be formed because it is constructed by the combination of flat plates in the same manner as mentioned above. In addition, since the inner hull of each double-sided hull construction includes continuance as a plane in spite of the presence of a bent part, a shearing force appearing in the longitudinal direction of the ship's body can be distributed across the double-sided hull construction section, whereby each double-sided hull construction serves as an effective structural element from the viewpoint of a structural strength. This leads to advantages that reinforcement for the shearing force is not required at all and economical properties can be improved by reduction in a weight of the hull structure.

The function derived from varying of the thickness of each double-sided hull construction in the vertical direction by the combination of slantwise extending flat plates is the same is that which has been described above with reference to the tenth embodiment of the present invention.

Additionally, according to the eleventh embodiment of the present invention, formation of the inner hull 119 of the double-sided hull construction section in conformity with extension of the outer plate of the ship body in the narrow-width part of the same ahead of the cargo oil tank section as well as astern of the same and the function derived from the foregoing formation are the same is those which have been described above with reference to the tenth embodiment of the present invention.

Figure 33:
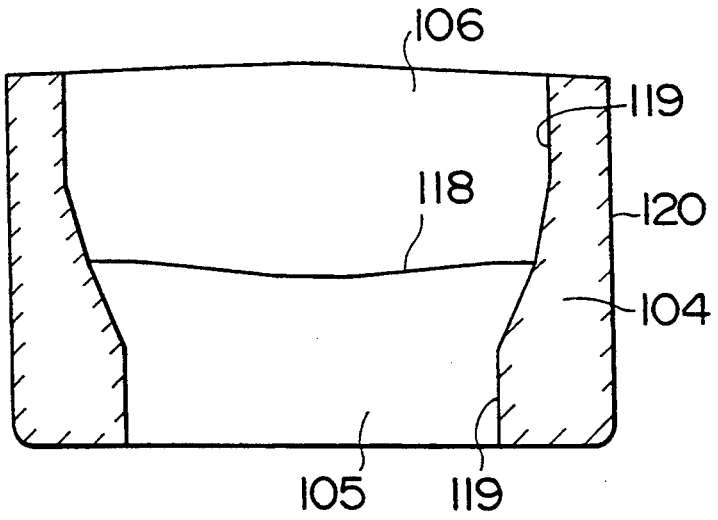
FIG. 33 is a cross-sectional view of a cargo oil spillage preventive type tanker in accordance with a twelfth embodiment of the present invention, schematically illustrating the structure of a ship body.
Figure 34:
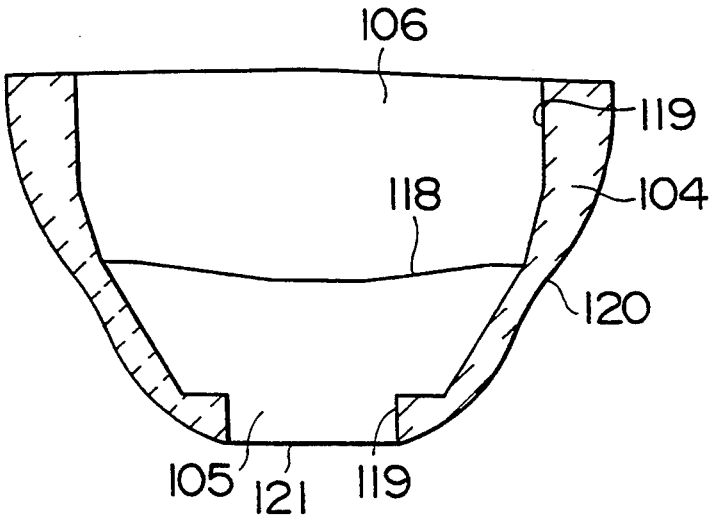
FIG. 34 is a cross-sectional view of the tanker in FIG. 33, particularly illustrating the narrow-width part of an outer plate of the ship body.

Next, FIG. 33 is a cross-sectional view of a cargo oil spillage preventive type tanker in accordance with a twelfth embodiment of the present invention. FIG. 34 is a cross-sectional view of the tanker in FIG. 33, particularly illustrating the narrow-width part of a outer plate of the ship body. According to the twelfth embodiment of the present invention, a mid-height deck as shown in FIG. 6 is employed for the tanker and an inner hull 119 is formed such that it includes vertical flat plates at the upper end part and the lower end part and slantwise extending flat plates having two kinds of slant angles at the intermediate part thereof while the position where slantwise extension of the flat plates varies coincides with the intersection where the mid-height deck 118 intersects the flat plates.

The tanker in accordance with the twelfth embodiment of the present invention is built based on the preceding embodiment shown in FIG. 31 and FIG. 32 such that the configuration of an inner hull 119 is bent in the vertical direction in the region in the vicinity of the upper deck as well in the region in the vicinity of an outer plate of the ship bottom. With respect to an upper cargo oil tank 106, a double-sided hull construction 104 is dimensioned to have a greater thickness in the vicinity of the upper deck than that shown in FIG. 31, and the effect for preventing outflow of a cargo oil is enhanced. It should be noted that since the available volume of the upper cargo oil tank 106 is reduced corresponding to the increased thickness of the double-sided hull construction, a thickness of the double-sided hull construction 104 in the vicinity of the outer plate of the ship bottom below a lower cargo oil tank 105 is reduced so as to secure the available volume of each cargo oil tank. When the lower cargo oil tank 105 is damaged or injured on the side wall thereof, a quantity of outflow of a cargo oil corresponds to a quantity of the cargo oil which has been filled in the space below the uppermost level of the damaged or injured part of the side wall. Therefore, when the side wall is damaged or injured at the lower part rather than the upper part thereof, the effect of preventing outflow of a cargo oil is enhanced. In view of the foregoing fact, it can be considered that an effect for preventing outflow of a cargo oil from the lower cargo oil tank 105 is kept equal, provided that the thickness of the double-sided hull construction 104 at the intersection where the mid-height deck 118 intersects the double-sided hull construction 104 is kept equal. Therefore, it is possible to maintain an available volume of each cargo oil tank without deterioration of the effect for preventing outflow of a cargo oil by vertically bending the inner hull 119 in the vicinity of the ship bottom.

The tanker shown in FIG. 34 is built such that a horizontal flat plate is arranged for the inner hull 119 in the vicinity of the ship bottom and the position where the inner hull 119 comes in contact with the outer plate coincides with the flat portion 121 of an outer plate of the ship bottom.

Arrangement of the fragmentary flat plate portion, the vertical flat plate portion and the slantwise extending flat plate portion in the above-described manner makes it possible to determine the configuration of the inner hull 119 so as to effectively maintain the available volume of each cargo oil tank while maintaining the minimum necessary thickness of the double-sided hull construction 104 in conformity with the configuration of the outer plate 120 constituting the ship's side wall.

As will be apparent from the above description, the tanker of the present invention offers the following advantageous effects.

(1) Since a cargo oil tank section is protected by double-sided hull constructions, outflow of a cargo oil in the event of damage or injury on a side wall of the ship can be prevented reliably. In addition, since the height of a mid-height deck for dividing each cargo oil tank into an upper cargo oil tank and a lower cargo oil tank is adequately determined, outflow of a cargo oil in the event of damage or injury to the ship bottom can reliably be prevented without necessity for employment of a plurality of double bottom constructions in any loaded state during cruising of the tanker.

(2) Since the mid-height deck is slanted, a sludge in the upper cargo oil tank is concentratively deposited on the low position of the mid-height deck. Thus, the sludge can effectively be removed together with a cargo oil by the effect of suction during a loading operation.

(3) Since the sludge which cannot be removed during the loading operation is distributed within a limited range on the slantwise extending mid-height deck having a low height, a work load to be borne during the loading operation is attenuated.

(4) Since not only the sludge but also the cargo oil are concentratively collected on a part of the mid-height deck having a lowest height, a dredging operation to be performed at the final stage of the loading operation can be accomplished at an improved operational efficiency. In addition, the loading operation is completed within a short period of time.

(5) Since the mid-height deck is slanted, a gas remaining above the oil level in the upper cargo oil tank can readily be removed from the higher location of the mid-height deck while the lower cargo oil tank is loaded with a cargo oil with the result that no air collecting spot appears at the top of the upper cargo oil tank. Thus, the loading operation can be performed at a high operational efficiency.

(6) Since the mid-height deck is slanted in the transversal direction of the ship body and the ship body is slightly inclined in the astern direction in the trimmed state during a loading operation, the mid-height deck is slanted also in the longitudinal direction of the ship body, resulting in the aforementioned advantageous effects being amplified.

(7) Since the mid-height deck is slanted in the longitudinal direction of the ship body in that way and moreover slantwise extension of the mid-height deck is enlarged by the trimmed state of the ship body during the loading operation, the aforementioned advantageous effects are amplified.

(8) Since the slantwise extending mid-height deck has a part having a lowest height within the range of the upper cargo oil tank at the intermediate part as seen in the longitudinal direction, this makes it possible to coincide the height of a part of the mid-height deck ahead of a transversally extending bulkhead with the height of a part of the mid-height deck astern of the transversal bulkhead serving as a partition between the adjacent cargo oil tanks. Reliability of the tanker in respect of a structural strength can be improved and moreover economical properties of the tanker can be improved.

(9) Since the mid-height deck has a slantwise extension in the longitudinal direction as well as a slantwise extension in the transversal direction, the aforementioned advantageous effects can be multiply enhanced.

(10) Since a vertical plate is employed for an inner hull of each double-sided hull construction, the tanker can most easily be designed and built while easily maintaining dimensional accuracy during building operations. In addition, reliability of the tanker can be improved substantially.

(11) Since the inner hull of each double-sided hull construction is formed by making selective combinations of vertical flat plates, horizontal flat plates and slantwise extending flat plates, the tanker can be built at a reduced cost while maintaining an effect for preventing outflow of a cargo oil in the event of damage or injury on a side wall of the ship and the ship bottom.

(12) Since means for stepwise varying a width of each double-sided hull construction is employed for the tanker, a part of the cargo oil tank section can be protected in the event of damage or injury to a side wall of the ship. This makes it possible to reduce the number of cargo oil tanks, whereby economical properties of the tanker can be improved.

(13) Since means for continuously varying a width of each double-sided hull construction in conformity with the configuration of the slantwise extending side wall is employed for the tanker, a shearing force can be borne by the inner hulls in the longitudinal direction of the ship body. Thus, a weight of each double-sided hull construction can be reduced and thereby economical properties of the tanker can be improved from the viewpoint of structure and design.

(14) Since a part of the cargo oil tank section which has not hitherto been sufficiently utilized as a cargo oil tank can effectively be utilized as a practical cargo oil tank while maintaining an effect for preventing outflow of a cargo oil also in the narrow-width part of an outer plate of the ship body not only in the region ahead of the cargo oil tank section but also in the region astern of the same, the tanker can be built in a smaller type, provided that each cargo oil tank has a predetermined available volume. Thus, the tanker can be built at a reduced cost. Additionally, the tanker can cruise at a reduced cost.

Figure 35:
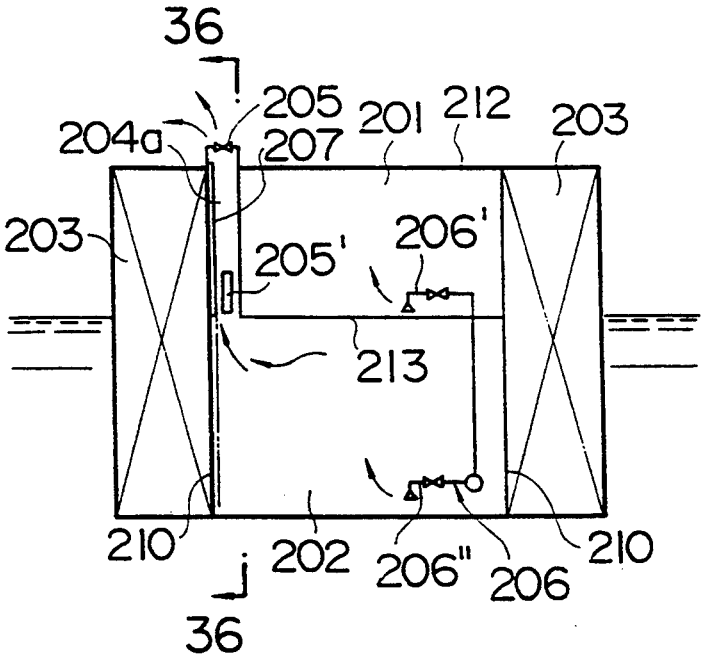
FIG. 35 is a cross-sectional view of a cargo oil spillage preventive type tanker including an access trunk to serve also as degassing means in accordance with a thirteenth embodiment of the present invention, schematically illustrating the structure of a ship body.
Figure 36:
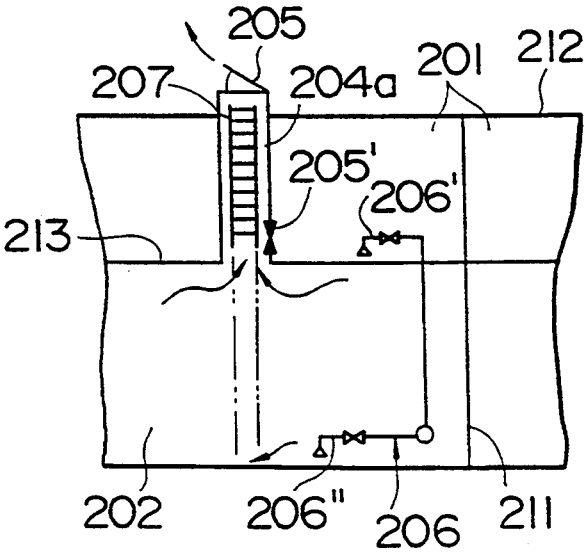
FIG. 36 is a vertical cross-sectional view of the tanker taken along line 36—36 in FIG. 35.

Next, FIG. 35 and FIG. 36 show a cargo oil spillage preventive type tanker including an access trunk to serve also as degassing means in accordance with a thirteenth embodiment of the present invention. FIG. 35 is a cross-sectional view of the tanker, schematically illustrating the structure of a ship body, and FIG. 36 is a vertical sectional view of the tanker as seen in the II arrow-marked direction in FIG. 35.

Figure 37:
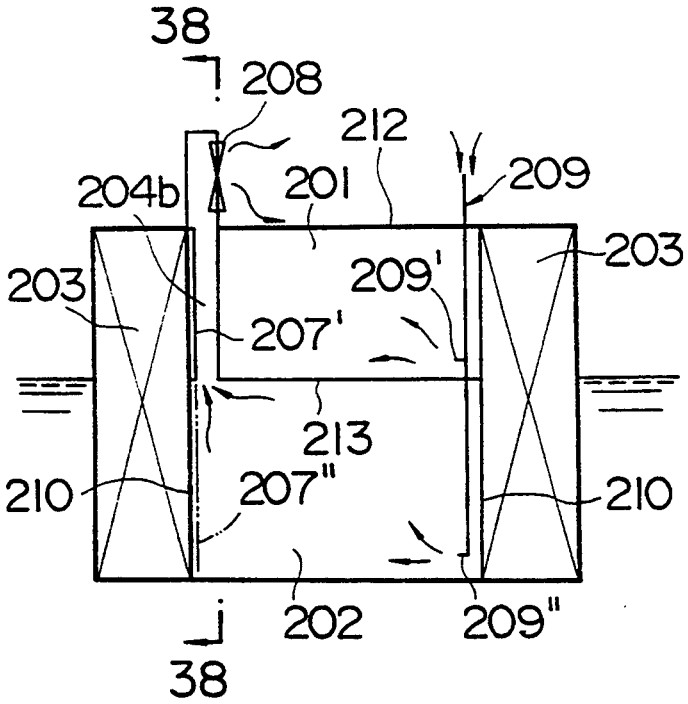
FIG. 37 is a cross-sectional view of a cargo oil spillage preventive type tanker including an access trunk to serve also as degassing means in accordance with a fourteenth embodiment of the present invention, schematically illustrating the structure of a ship body.
Figure 38:
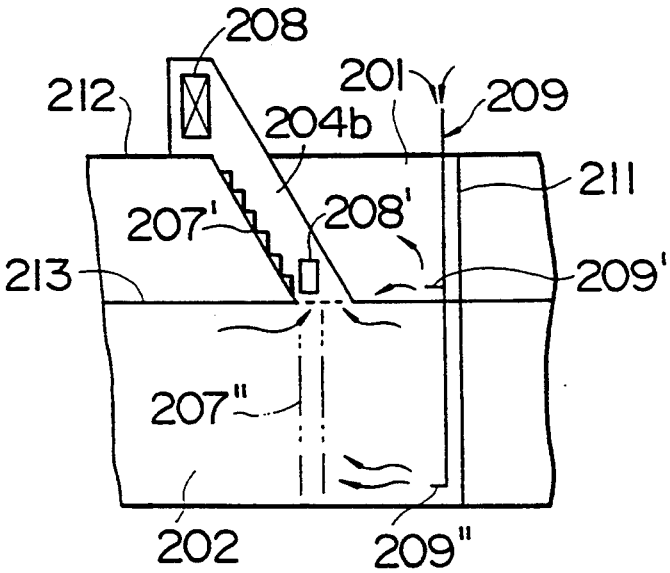
FIG. 38 is a vertical cross-sectional view of the tanker taken along line 38—38 in FIG. 37.
Figure 39:
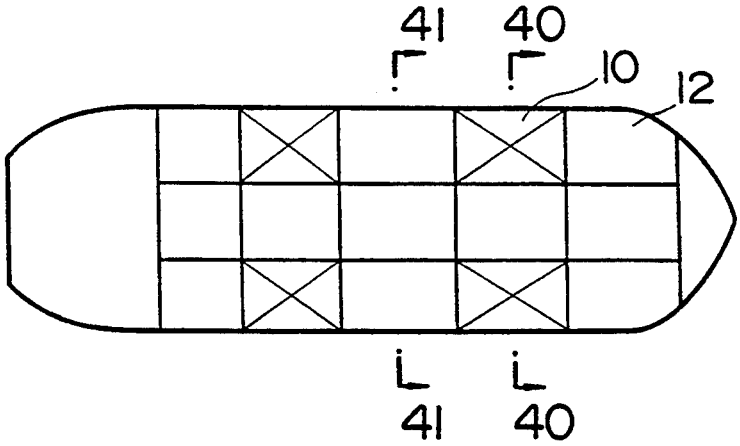
FIG. 39 PRIOR ART
FIG. 39 is a horizontal cross-sectional plan view of a first conventional tanker, schematically illustrating the structure of a ship's body.
Figure 40:
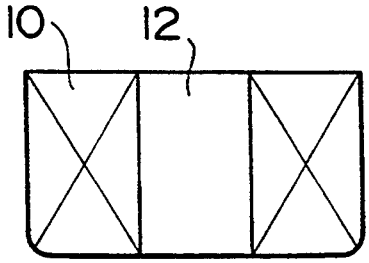
FIG. 40 PRIOR ART
FIG. 40 is a cross-sectional view of the conventional tanker taken along line 40—40 in FIG. 39.
Figure 41:
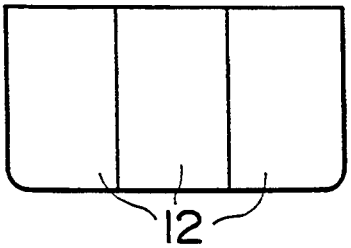
FIG. 41 PRIOR ART
FIG. 41 is a cross-sectional view of the conventional tanker taken along line 41—41 in FIG. 39.
Figure 42:
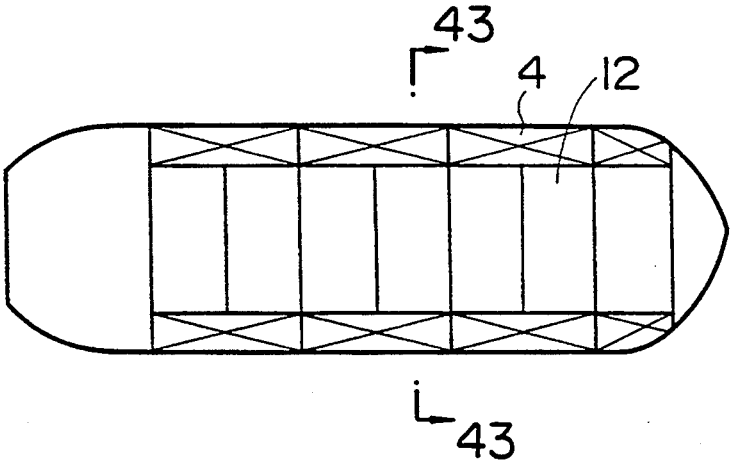
FIG. 42 PRIOR ART
FIG. 42 is a horizontal cross-sectional plan view of a second conventional tanker, schematically illustrating the structure of a ship body.
Figure 43:
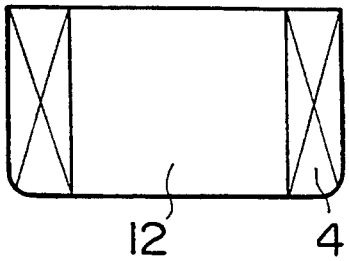
FIG. 43 PRIOR ART
FIG. 43 is a cross-sectional view of the conventional tanker taken along line 43—43 in FIG. 42.
Figure 44:
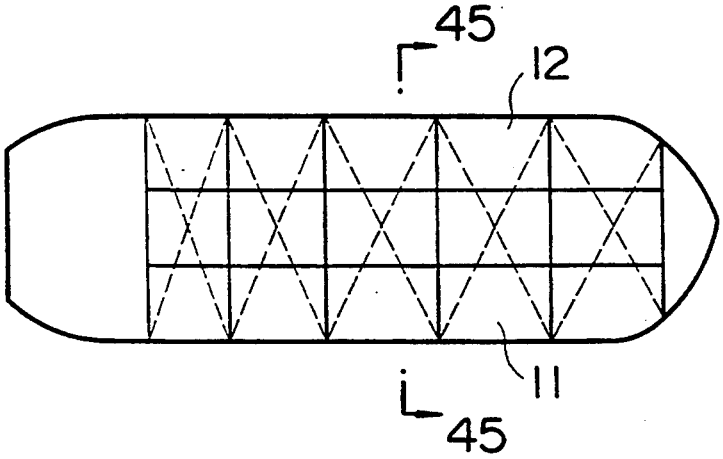
FIG. 44 PRIOR ART
FIG. 44 is a horizontal cross-sectional plan view of a third conventional tanker, schematically illustrating the structure of a ship body.
Figure 45:
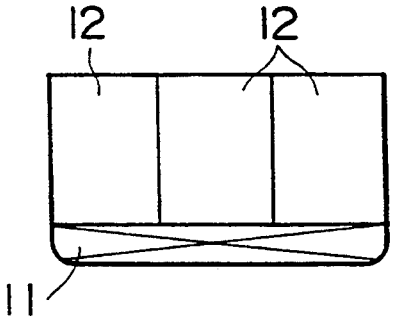
FIG. 45 PRIOR ART
FIG. 45 is a cross-sectional view of the conventional tanker taken along line 45—45 in FIG. 44.
Figure 46:
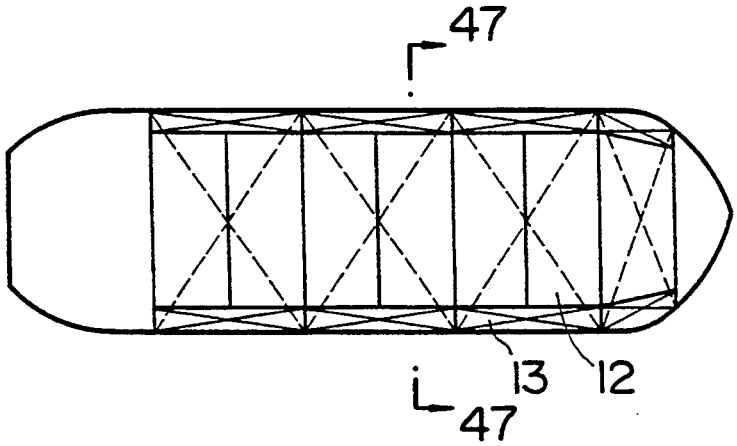
FIG. 46 PRIOR ART
FIG. 46 is a horizontal cross-sectional plan view of a fourth conventional tanker, schematically illustrating the structure of a ship body.
Figure 47:
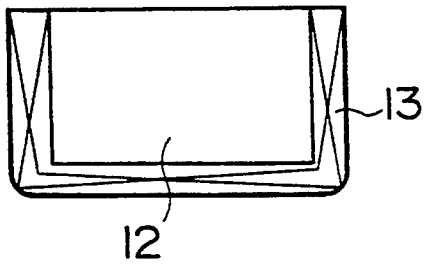
FIG. 47 PRIOR ART
FIG. 47 is a cross-sectional view of the conventional tanker taken along line 47—47 in FIG. 46.
Figure 48:
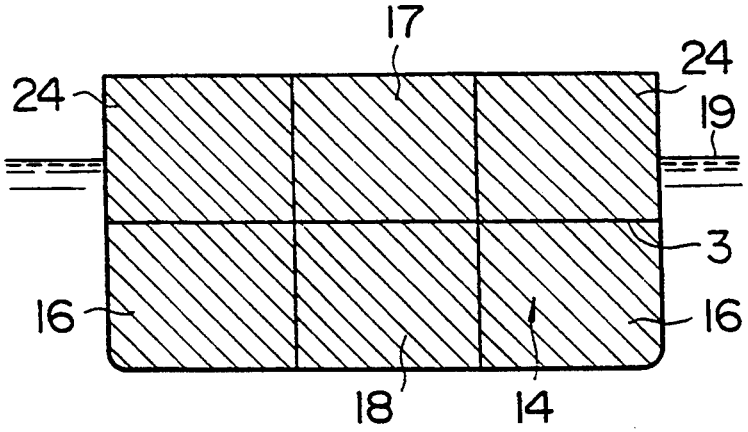
FIG. 48 PRIOR ART
FIG. 48 is a cross-sectional view of a fifth conventional tanker, schematically illustrating the structure of a ship body.
Figure 49:
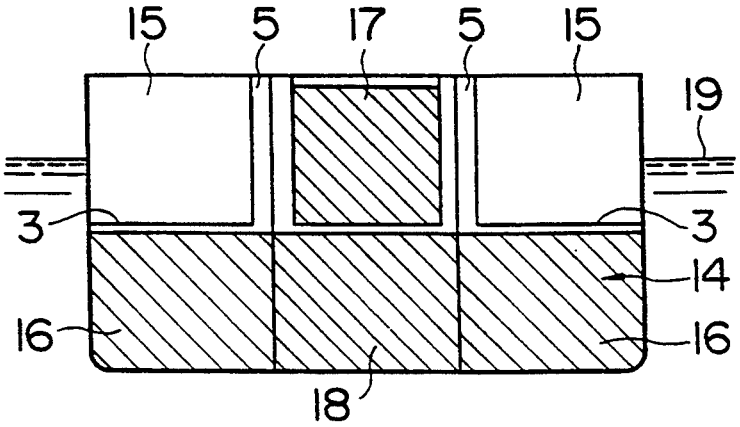
FIG. 49 PRIOR ART
FIG. 49 is a cross-sectional view of a sixth conventional tanker, schematically illustrating the structure of a ship body.
Figure 50A:
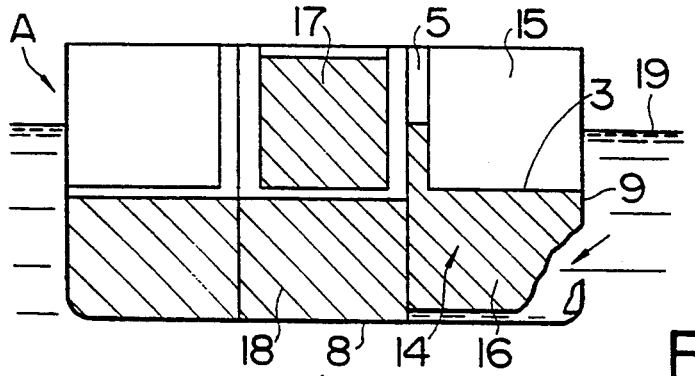
FIG. 50A PRIOR ART
FIGS. 50A, 50B and 50C are a cross-sectional view of the conventional tanker in FIG. 49, particularly illustrating a process of outflow of a cargo oil in the event of damage or injury on a part of the ship side wall.
Figure 50B:
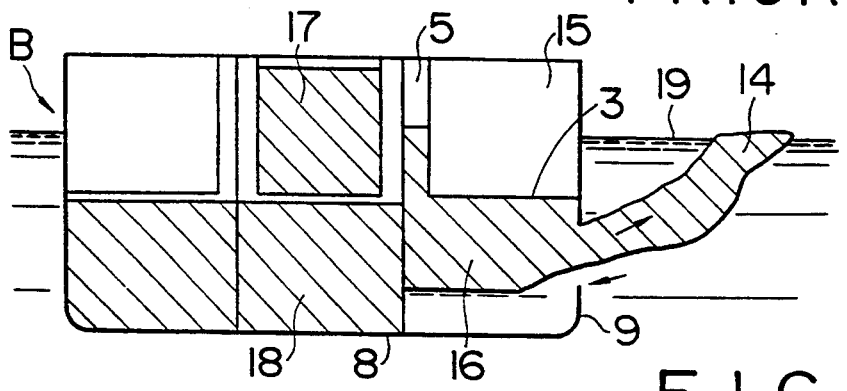
FIG. 50B PRIOR ART
Figure 50C:
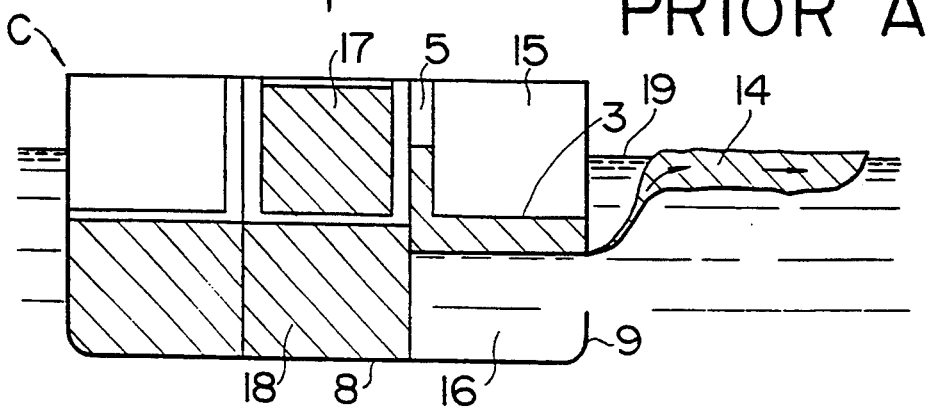
FIG. 50C PRIOR ART

In addition, FIG. 37 and FIG. 38 show a cargo oil spillage preventive type tanker including an access trunk to serve also as degassing means in accordance with a fourteenth embodiment of the present invention. FIG. 37 is a cross-sectional view of the tanker, schematically illustrating the structure of a ship body, and FIG. 38 is a vertical sectional view of the tanker as seen in the IV arrow-marked direction in FIG. 37.

According to the thirteenth embodiment of the present invention shown in FIG. 35 and FIG. 36, the tanker includes broadside tanks 203 serving as left-hand/right-hand water ballast tanks, vertical hulls 210 located inside of the broadside tanks 203, a plurality of upper tanks 201 and lower tanks 202 arranged below an upper deck 212 with a mid-height deck 213 therebetween and a series of transversal bulkheads 211.

To assure that an inert gas filled in the upper tanks 201 and the lower tanks 202 is simultaneously replaced with fresh air after completion of a loading operation, the tanker includes an air feeding system 206 for feeding air to each upper tank 201 and each lower tank 202 via air feeding branch tubes 206' and 206'' and an inert gas discharging system (not shown) which is connected to each upper tank 201. Each lower tank 202 is provided with an access trunk **204*a* which serves also as an inner gas discharging system while extending from the upper deck 212 down to the lower tank 202**.

According to the thirteenth embodiment of the present invention, the air feeding system 206 serves also as a pipe line having a cargo oil pump disposed thereon so as to perform a loading operation with a cargo oil.

The access trunk 204 includes an oil-tight hatch 205 at the upper end thereof, and a vertically extending ladder 207 is arranged in the access trunk 204.

With the foregoing construction, when the upper tank 201 and the lower tank 202 are loaded with a cargo oil, an inert gas filled in the upper tank 201 and the lower tank 202 is conducted to the inert gas discharging system (not shown) connected to the upper tank 201 and the access trunk **204*a* connected to the lower tank 202 as fresh air is fed to the upper tank 201 and the lower tank 202 via the air feeding system 206 and the air feeding branch tubes 206' and 206''**. Thereafter, the inert gas is discharged to the outside from the tanker.

Thus, the inert gas in the upper tank 201 and the lower tank 202 is replaced with fresh air in the above-described manner. Particularly, according to the thirteenth embodiment of the present invention, since arrangement is made such that the access trunk 204 serves also as an inert gas discharging system connected to the lower tank 202, there is no need of increasing the number of inert gas discharging systems corresponding to the number of lower tanks 202 which are increased by dividing the interior of the ship body into a plurality of cargo oil tanks with the aid of the mid-height deck 218. Thus, the tanker can be built with a simplified structure at a reduced cost.

The access trunk **204*a* may serves as an access trunk for the upper tank 201 and an inert gas discharging system by disposing an oil-tight door 205' which leads to the upper tank 201**.

Further, the access trunk **204*a*** can be utilized as a space for overflowing a cargo oil in the event of inflow of a sea water through a damaged or injured part on the ship bottom due to stranding of the ship body or the like malfunction.

Next, according to the fourteenth embodiment of the present invention shown in FIG. 37 and FIG. 38, an access trunk **204*b* including an oil-tight door 208 which leads to the lower tank 202 is slantwise arranged in the cargo oil tank section. In addition, a slant ladder 207' is arranged in the access trunk 204*b*, while a downwardly extending vertical ladder 207'' is arranged in the lower tank 202. The tanker is equipped with an air feeding system 209 to serve as an air purging system for sucking fresh air from the outside therethrough with a cover kept opened. The air feeding system 209 is arranged separately from a cargo oil loading system. The air feeding system 209 is substantially same to that in the thirteenth embodiment of the present invention with the exception that an air feeding branch tube 209' is communicated with the upper tank 201 at the lower part thereof and another air feeding branch tube 209'' is communicated with the lower tank 202** at the lower part thereof.

The tanker in accordance with the fourteenth embodiment of the present invention can provide the same functional effects as those in the thirteenth embodiment of the present invention.

When the access trunk **204*b* is provided with an oil-tight door 208' which leads to the upper tank 201, it can serve also as an access trunk for the upper tank 201** and an inert gas discharging system.

As will be apparent from the above description, the tanker of the present invention offers the following advantageous effects.

(1) Since an access trunk for each lower tank serves also as an inert gas discharging system without necessity for increasing the number of inert gas discharging systems by a quantity corresponding to the number of lower tanks which is increased by dividing the interior of a cargo oil tank section into a plurality of upper tanks and lower tanks with a mid-height deck therebetween while preventing outflow of a cargo oil in the event of damage or injury to the ship body, the tanker can be built with a simplified structure at a reduced cost.

(2) When arrangement is made such that the access trunk for the lower tank serves also as an inert gas discharging system for the upper tank, the tanker can be built with a more simplified structure at a reduced cost.

(3) Since the tanker is equipped with a common air feeding system to the upper tank and the lower tank, an inert gas in the respective tanks can simultaneously be replaced with fresh air.

(4) The access trunk can be utilized as a space for overflowing a cargo oil in the event of inflow of sea water through a damaged or injured part on the ship bottom due to stranding of the ship body or similar malfunction.

While the present invention has been described above with respect to fourteen preferred embodiments thereof, it should of course be understood that the present invention should not be limited only to these embodiments but various changes or modifications may be made without departure from the scope of the invention as defined by the appended claims.

We claim:

1. A tanker comprising:

a ship body having side walls and a bottom;

a plurality of cargo oil tanks arranged in an interior of said ship body;

double-sidewall hull constructions arranged on opposite sides of said cargo oil tanks to prevent outflow of cargo oil from said cargo oil tanks to outside of said side walls;

a mid-height deck arranged to divide said cargo oil tanks into upper cargo oil tanks and lower cargo oil tanks;

air venting tube means for said lower cargo oil tanks;

pressure control valve means in said air venting tube means;

the pressure of cargo oil exerted on said bottom being the sum of the pressure due to the weight of cargo oil and a maximum set pressure value of said pressure control valve means in said air venting tube means for said lower cargo oil tanks; and said mid-height deck having a highest position in a direction of height measured from said bottom determined to be lower than a position at which the following two pressures are equalized:

pressure of cargo oil exerted on said bottom when each lower cargo oil tank is filled with cargo oil from said bottom to the position of the mid-height deck under a condition of minimum ship draft as the tanker cruises with a cargo oil in said cargo oil tanks, and pressure of sea water exerted on said bottom;

so that said pressure of seawater is always greater than said cargo oil pressure in each lower cargo oil tank and prevents flow of oil out of said lower cargo oil tanks through a rupture in said bottom.

2. The tanker as claimed in claim 1, wherein:

said ship body has a longitudinal center line; and said mid-height deck is formed so that it has a lowest height in a region near said longitudinal center line of said ship body and is gradually elevated therefrom toward said side walls.

3. The tanker as claimed in claim 1, wherein:

said ship body has a longitudinal center line; and said mid-height deck is formed so that it has a highest height in a region near said longitudinal center line of said ship body and is gradually lowered toward said side walls.

4. The tanker as claimed in claim 1, wherein:

said mid-height deck is slanted in a longitudinal direction of the ship body within a range of each upper cargo tank.

5. The tanker as claimed in claim 1, wherein:

said mid-height deck is formed so that it has an intermediate part and a lowest height at said intermediate part in a longitudinal direction of said ship body within a range of each upper cargo oil tank and is gradually elevated from said intermediate part in the forward direction and in the astern direction.

6. The tanker as claimed in claim 1, wherein:

said ship body has a longitudinal center line; and said mid-height deck is formed so that it is slanted in a longitudinal direction of said ship body within a range of each upper cargo oil tank, has a lowest height in a region near said center line of said ship body on a transversely extending plane of said ship body and is gradually elevated toward said side walls.

7. The tanker as claimed in claim 1, wherein:

said ship body has a longitudinal center line; and said mid-height deck is formed so that it is slanted in a longitudinal direction of the ship body within a range of each upper cargo oil tank, has a highest height in a region near said center line of said ship body on a transversely extending plane of said ship body and is gradually lowered toward said side walls.

8. The tanker as claimed in claim 1 wherein:

each double-sidewall hull construction comprises an inner hull formed by a flat plate extending continuously in a substantially vertical direction for at least the total height of said upper cargo oil tank and said lower cargo oil tank.

9. The tanker as claimed in claim 1 wherein:

said upper and lower cargo oil tanks each have side walls slanting upwardly at respective slant angles relative to vertical; and each double sidewall hull construction comprises an inner hull formed by a slanting side wall of said upper cargo oil tank and a slanting side wall of said lower cargo oil tank, said slant angle of said slanted side wall of said lower cargo oil tank being larger than said slant angle of said slanted side wall of said upper cargo oil tank.

10. The tanker as claimed in claim 1, wherein:

said upper and lower cargo tanks each have side walls;

each side wall of each upper cargo oil tank comprises a section slanting upwardly and outwardly and a vertical section;

each side wall of each lower cargo oil tank comprises a section slanting upwardly and outwardly, a vertical section and a horizontal section between said section slanting upwardly and outwardly and said vertical section of said lower cargo tanks; and each double-sidewall hull construction comprises an inner hull formed by said sections of said side walls of said upper and lower cargo tanks.

11. The tanker as claimed in claim 1 and further comprising:

access trunk means extending from a position on an upper deck to said lower cargo oil tank to facilitate replacing an inert gas filled in the lower cargo oil tank with fresh air; and an air feeding system for feeding said lower cargo oil tank with fresh air.

12. The tanker as claimed in claim 1, wherein:

said upper and lower cargo tanks each have side walls;

each side wall of each upper cargo oil tank comprises a section slanting upwardly and outwardly and a vertical section; and each side wall of each lower cargo oil tank comprises a section slanting upwardly and outwardly and a vertical section; and each double-sidewall hull construction comprises an inner hull formed by said sections of said side walls of said upper and lower cargo tanks.

13. The tanker as claimed in claim 1 wherein:

said mid-height deck is substantially horizontal.

* * * * *